US006806009B2

(12) United States Patent
Tanaka et al.

(10) Patent No.: US 6,806,009 B2
(45) Date of Patent: Oct. 19, 2004

(54) ELECTROPHOTOGRAPHIC PHOTOSENSITIVE MEMBER, PROCESS CARTRIDGE AND ELECTROPHOTOGRAPHIC APPARATUS

(75) Inventors: Daisuke Tanaka, Shizuoka (JP); Yosuke Morikawa, Kanagawa (JP); Tatsuya Ikezue, Kanagawa (JP); Kouichi Nakata, Shizuoka (JP); Kimihiro Yoshimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/314,354

(22) Filed: Dec. 9, 2002

(65) Prior Publication Data

US 2003/0194625 A1 Oct. 16, 2003

(30) Foreign Application Priority Data

Dec. 21, 2001 (JP) ..... 2001-389242

(51) Int. Cl.[7] ..... G03G 5/147

(52) U.S. Cl. ..... 430/66; 430/59.6; 430/58.65; 430/58.8; 399/159

(58) Field of Search ..... 430/66, 58.05, 430/59.6, 58.65, 58.8; 399/159

(56) References Cited

U.S. PATENT DOCUMENTS

| | | | | |
|---|---|---|---|---|
| 4,880,717 A | | 11/1989 | Kitagawa et al. | 430/58 |
| 5,008,172 A | | 4/1991 | Rokutanzono et al. | 430/67 |
| 6,335,133 B1 | * | 1/2002 | Nagasaka | 430/64 |
| 6,337,165 B1 | * | 1/2002 | Fujii et al. | 430/58.05 |
| 6,562,530 B2 | * | 5/2003 | Morikawa et al. | 430/66 |
| 2001/0036585 A1 | | 11/2001 | Komatsu et al. | 430/100 |
| 2002/0045116 A1 | | 4/2002 | Morikawa et al. | 430/66 |

FOREIGN PATENT DOCUMENTS

| | | |
|---|---|---|
| CA | 2351118 A14 | 12/2001 |
| EP | 01041449 | 10/2000 |
| EP | 1172701 A2 | 1/2002 |
| JP | 57030846 | 2/1982 |
| JP | 62295066 | 12/1987 |
| JP | 1306857 | 12/1989 |
| JP | 2050167 | 2/1990 |
| JP | 5181299 | 7/1993 |
| JP | 6082223 | 3/1994 |
| JP | 10228126 | 8/1998 |
| JP | 10228127 | 8/1998 |

* cited by examiner

*Primary Examiner*—John L Goodrow
(74) *Attorney, Agent, or Firm*—Fitzpatrick, Cella, Harper & Scinto

(57) ABSTRACT

In an electrophotographic photosensitive member comprising a cylindrical support, and provided thereon a photosensitive layer and a protective layer in this order, which cylindrical support has an outer diameter of less than 30 mm, the difference between a coefficient of thermal expansion $\alpha_1$ measured from the top of the protective layer and a coefficient of thermal expansion $\alpha_2$ measured after the protective layer has been removed, $|\alpha_1-\alpha_2|$, is more than $5.0\times10^{-7}$° C.$^{-1}$ to less than $1.0\times10^{-4}$° C.$^{-1}$, and the modulus of elastic deformation We % measured from the top of the protective layer is more than 30% to less than 60%. Also disclosed are a process cartridge and an electrophotographic apparatus which have such an electrophotographic photosensitive member.

27 Claims, 4 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member. More particularly, it relates to an electrophotographic photosensitive member having on a cylindrical support a photosensitive layer and a protective layer in this order, which cylindrical support has an outer diameter of less than 30 mm; and a process cartridge and an electrophotographic apparatus which have such an electrophotographic photosensitive member.

2. Related Background Art

With achievement of high image quality and high-speed and high-durability image formation in recent years, organic electrophotographic photosensitive members making use of organic photoconductive materials are also required to be more improved in mechanical durability.

In recent years, electrophotographic apparatus such as printers, copying machines and facsimile machines making use of electrophotographic photosensitive members have also come into wide use in various fields, and are more severely required to provide images which are always stable even in more various environments.

Electrophotographic photosensitive members, to which electrical and mechanical external forces are directly applied, are required to have durabilities to such forces. Stated specifically, they are required to have durability to the occurrence of surface wear and scratches due to friction and durability to the deterioration of surface layer that is caused by adhesion of active substances such as ozone and nitrogen oxides generated at the time of charging.

In addition, electrophotographic photosensitive members are repeatedly put to steps of charging, exposure, development, transfer, cleaning and charge elimination. An electrostatic latent image formed upon charging and exposure is made into a toner image by the use of a toner. This toner image is further transferred to a transfer material such as paper by a transfer means, where it is not that the toner of the toner image is all transferred but that it remains partly on the surface of the photosensitive member as a transfer residual toner.

If this transfer residual toner is in a large quantity, i.e., any faulty transfer occurs, the image on the transfer material comes into an image with what is called crumbling blank areas. This not only results in lack of image uniformity but also may cause a problem that the melt adhesion of toner or filming occurs on the electrophotographic photosensitive member. To solve such a problem, it is required to improve the releasability of the surface layer of the electrophotographic photosensitive member.

To meet such requirements, it has been attempted to provide protective layers of various types. Among various attempts, protective layers composed chiefly of resins have been proposed in a large number. For example, as disclosed in Japanese Patent Application Laid-Open No. 57-30846, a protective layer is proposed which is formed of a binder resin to which a metal oxide is added as conductive particles so that its volume resistivity can be controlled.

As also disclosed in Japanese Patent Application Laid-Open No. 6-82223, it is proposed to use a curable phenolic resin as a resin for protective layers. However, in an electrophotographic photosensitive member disclosed in this publication, carbon fluoride is dispersed in its protective layer, and hence the resin of the protective layer has a low transparency to make images have a poor one-dot reproducibility.

The metal oxide is dispersed in the protective layer of an electrophotographic photosensitive member chiefly in order to control the volume resistivity of the protective layer itself to prevent residual potential from increasing in the photosensitive member as the electrophotographic process is repeated. It is known that suitable volume resistivities of protective layers for electrophotographic photosensitive members are $10^{10}$ to $10^{15}$ Ω·cm.

However, where the volume resistivity is within the above range, the volume resistivity of the protective layer tends to be affected by ion conduction, and hence the volume resistivity tends to undergo great changes depending on environmental changes. In particular, in the case when the metal oxide is dispersed in the protective layer, the metal oxide surface has so high water absorption properties that it has hitherto been very difficult to keep the volume resistivity of the protective layer within the above range in every environment and besides in the repetition of the electrophotographic process. Especially in an environment of high humidity, the volume resistivity may gradually lower with leaving and the active substances such as ozone and nitrogen oxides generated at the time of charging may repeatedly adhere to the surface. These may cause a decrease in volume resistivity of the electrophotographic photosensitive member surface layer and a lowering of releasability of toner from the surface layer, bringing about problems that defects such as what is called smeared images and blurred images may occur and that an insufficient image uniformity may result.

Where particles are dispersed in the protective layer as commonly done, it is preferable for the particles to have a particle diameter which is smaller than the wavelength of incident light, i.e., 0.3 μm or less.

However, metal oxide particles usually tend to agglomerate in a resin solution and may uniformly be dispersed with difficulty. Even if they have once been dispersed, they tend to cause secondary agglomeration or sedimentation. Accordingly, it has been very difficult to stably produce films in which fine particles of 0.3 μm or less in particle diameter are dispersed in a good state.

In addition, from the viewpoint of improving the transparency and conduction uniformity of the protective layer, it is preferable to disperse ultrafine particles having especially small particle diameter (0.1 μm or less in primary particle diameter), but such ultrafine particles tend to have poorer dispersibility and dispersion stability.

In order to compensate the above disadvantage, for example, Japanese Patent Application Laid-Open No. 1-306857 discloses a protective layer to which a fluorine-atom-containing silane coupling agent, a titanate coupling agent or a compound such as $C_7F_{15}NCO$ has been added; Japanese Patent Application Laid-Open No. 62-295066, a protective layer in a binder resin of which fine metal particles or fine metal oxide particles improved in dispersibility and moisture resistance by water-repellent treatment have been dispersed; and Japanese Patent Application Laid-Open No. 2-50167, a protective layer in a binder resin of which fine metal oxide particles surface-treated with any of a titanate coupling agent, a fluorine-atom-containing silane coupling agent and an acetoalkoxyaluminum diisopropionate have been dispersed.

An example in which a charge-transporting material having a hydroxyl group is contained in the protective layer is also disclosed in, e.g., Japanese Patent Application Laid-Open Nos. 10-228126 and 10-228127.

An example in which a phenolic resin is used as the binder resin used in the protective layer is also disclosed in, e.g., Japanese Patent Application Laid-Open No. 5-181299.

Under existing circumstances, however, even these protective layers have not achieved any durability and releasability against various impact to surface and against wear and scratching, which are high enough to be able to meet the high durability and high image quality required in recent years.

In addition, there is an increasing need for space saving, and it is driven by necessity to make small the size of the main body of an electrophotographic apparatus. Accordingly, it is necessary to manufacture electrophotographic photosensitive members adapted to the size of the main body, and it is essential to make electrophotographic photosensitive members have a small diameter.

However, in an attempt to make achievement both for manufacturing an electrophotographic photosensitive member having a protective layer with wear resistance and for making the electrophotographic photosensitive member have a small diameter, there is a very great problem.

Not coming into question so much in electrophotographic photosensitive members having a diameter employed commonly in conventional cases, as a result of making the electrophotographic photosensitive member have a small diameter, a great stress is applied to the protective layer. Loads are applied thereto from members coming into direct contact with the electrophotographic photosensitive member, such as a charging means, a developing means and a transfer means when it is mounted to the electrophotographic apparatus. This may consequently cause a problem that the protective layer comes off because of any small scratches made during processing. This problem comes more remarkable when a curable resin is used as the binder resin of the protective layer.

Moreover, because of the fact that the electrophotographic photosensitive member has a small diameter, it must be rotated in a larger number than conventional electrophotographic photosensitive members in order to reproduce images on one sheet, so that a much greater load is applied to the electrophotographic photosensitive member.

Where the protective layer is made to have a small modulus of elastic deformation in order to relax the stress, it follows that the electrophotographic photosensitive member is rotated dragging any external additives of toner which have adhered to the protective layer. This may inevitably cause deep scratches, so that the protective layer may not function as such any longer.

In addition, the internal temperature of the electrophotographic apparatus tends to rise during image reproduction, and the temperature of the electrophotographic photosensitive member also rises correspondingly to the internal temperature of the electrophotographic apparatus, so that any difference in coefficient of thermal expansion between the protective layer and the photosensitive layer may make poor the adherence between the both layers. If a load is applied to the electrophotographic photosensitive member in this state, the protective layer may inevitably lift or come off because the adherence between them stands poor.

SUMMARY OF THE INVENTION

An object of the present invention is to solve the above problems to provide an electrophotographic photosensitive member which does not cause any come-off of, or toner's melt adhesion to, the protective layer even where the photosensitive layer and the protective layer are formed on a small-diameter cylindrical support, and has a protective layer having superior scratch resistance and wear resistance; and a process cartridge and an electrophotographic apparatus which have such an electrophotographic photosensitive member.

As a result of extensive studies, the present inventors have discovered that the above problems can be solved as long as, in an electrophotographic photosensitive member having a photosensitive layer and a protective layer on a small-diameter cylindrical support, the difference between a coefficient of thermal expansion measured from the top of the protective layer and a coefficient of thermal expansion measured after the protective layer has been removed and the modulus of elastic deformation measured from the top of the protective layer are within specific ranges.

More specifically, the present invention is an electrophotographic photosensitive member comprising a cylindrical support, and provided thereon a photosensitive layer and a protective layer in this order, which cylindrical support has an outer diameter of less than 30 mm, wherein;

the difference between a coefficient of thermal expansion ($\alpha_1$) measured from the top of the protective layer and a coefficient of thermal expansion ($\alpha_2$) measured after the protective layer has been removed, $|\alpha_1-\alpha_2|$, is more than $5.0\times10^{-7\circ}$ C.$^{-1}$ to less than $1.0\times10^{-4\circ}$ C.$^{-1}$; and the modulus of elastic deformation We % measured from the top of the protective layer is more than 30% to less than 60%.

The present invention is also a process cartridge comprising an electrophotographic photosensitive member and at least one means selected from the group consisting of a charging means, a developing means, a transfer means and a cleaning means which are integrally supported, and being detachably mountable to the main body of an electrophotographic apparatus, wherein;

the electrophotographic photosensitive member is the electrophotographic photosensitive member described above.

The present invention is still also an electrophotographic apparatus comprising an electrophotographic photosensitive member, a charging means, an exposure means, a developing means and a transfer means, wherein;

the electrophotographic photosensitive member is the electrophotographic photosensitive member described above.

DESCRIPTION OF THE PREFERRED EMBODIMENTS

Figure 1A:
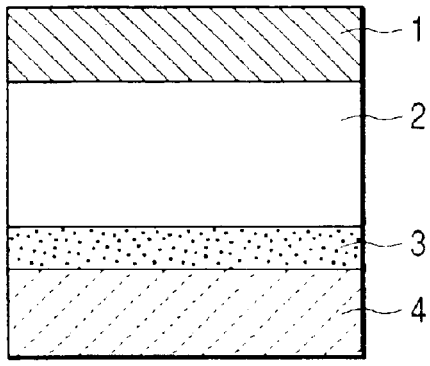
FIGS. 1A, 1B and 1C each illustrate the layer construction of the electrophotographic photosensitive member of the present invention.

The present invention is described below in detail.

In the present invention, the coefficient of thermal expansion is measured with TMA/SS150, manufactured by Seiko Denshi Kogyo K.K. TMA/SS150 is an instrument for examining dimensional changes caused by thermal expansion and shrinkage of a sample. It can measure coefficients of expansion, glass transition, softening, expansion, stress or strain, stress relaxation and so forth.

In the measurement with TMA/SS150, the measurement in a penetration mode is selected taking account of the shape of the electrophotographic photosensitive member. A load is so applied at 500 mN that the needle may touch the photosensitive layer at a constant pressure of 49.03 mN, and how the needle moves up and down when the sample expands is plotted. Also, the measurement is made in a temperature range of from room temperature (23° C.) to 170° C. at a heating rate of 5° C./min.

In the measurement made, the sample is seen to expand with rise of temperature in all cases, which expands proportionally up to the glass transition temperature (Tg) of the photosensitive layer (or a charge transport layer in the case of a multi-layer type photosensitive layer; the same applies hereinafter). Then, at temperature exceeding the Tg of the photosensitive layer, the photosensitive layer softens at a stretch, whereupon the needle penetrates into the photosensitive layer.

Accordingly, the coefficient of thermal expansion in the present invention is the value found when an approximate line is drawn at the part standing expanded proportionally on the side lower than the Tg of a resin of the photosensitive layer, i.e., on the side lower than the softening point, where its gradient is determined, and the gradient thus determined is divided by the total of the thickness of the protective layer and that of the photosensitive layer at room temperature in the case of the measurement made from the top of the protective layer, and by the thickness of the photosensitive layer at room temperature in the case of the measurement made after the protective layer has been removed.

Since the difference between the value found by measurement made from the top of the protective layer and the value found by measurement made after the protective layer has been removed is taken, any influence of the expansion of the support and of a layer or layers beneath the photosensitive layer is negligible. Here, the layer or layers beneath the photosensitive layer include(s) a charge generation layer in the case in which the photosensitive layer is of a multi-layer type.

In the present invention, when the protective layer is removed, it is mechanically removed by polishing.

In the present invention, the difference between a coefficient of thermal expansion ($\alpha_1$) measured from the top of the protective layer and a coefficient of thermal expansion ($\alpha_2$) measured after the protective layer has been removed, $|\alpha_1-\alpha_2|$, is more than $5.0\times10^{-7}$° C.$^{-1}$ to less than $1.0\times10^{-4}$° C.$^{-1}$.

If the difference between both the coefficients of thermal expansion is not more than $5.0\times10^{-7}$° C.$^{-1}$, in a case in which any member, e.g., a cleaning blade, coming into contact with the electrophotographic photosensitive member touches it during image reproduction, the sound of a rubbing of the cleaning blade against the electrophotographic photosensitive member, what is called "chattering", may come large. Details of this problem have not completely been elucidated, and it is considered that this is due to a small difference between the coefficient of thermal expansion of the protective layer and that of the photosensitive layer, which is so small that, even when the in-machine temperature of the electrophotographic apparatus having the electrophotographic photosensitive member rises, these layers are in too close adhesion to be able to well disperse the force received from contact members and so forth.

On the other hand, if the difference between both the coefficients of thermal expansion is not less than $1.0\times10^{-4}$° C.$^{-1}$, the adhesion between the protective layer and the photosensitive layer may come poor upon rise of in-machine temperature to a certain temperature. Also, because of a large curvature of the cylindrical support of the electrophotographic photosensitive member, the protective layer can not withstand its stress to finally come off from the photosensitive layer.

The difference between a coefficient of thermal expansion ($\alpha_1$) measured from the top of the protective layer and a coefficient of thermal expansion ($\alpha_2$) measured after the protective layer has been removed, $|\alpha_1-\alpha_2|$, may also more preferably be more than $1.0\times10^{-6}$° C.$^{-1}$ to less than $7.0\times10^{-5}$° C.$^{-1}$.

In the present invention, the modulus of elastic deformation (We %) measured from the top of the protective layer is more than 30% to less than 60%.

In the present invention, the modulus of elastic deformation We % is measured with a hardness meter FISCHER SCOPE H100 (trade name), manufactured by Fischer Instruments Co., Germany. This is hereinafter called a Fischer hardness meter.

The modulus of elastic deformation is measured in an environment of 23° C./55% RH in all cases.

The method the Fischer hardness meter employs for measuring the modulus of elastic deformation is not a method in which an indenter is pressed into the surface portion of a sample and any indentation remaining after the load has been removed is measured with a microscope as in the conventional Microvickers method, but a method in which a preset load is stepwise applied to an indenter to indent it on to the film and the depth of indentation under application of the load is electrically detected to determine continuous hardness.

Stated specifically, the modulus of elastic deformation is determined in the following way:

Under application of a load using a quadrangular-pyramid diamond indenter whose angle between the opposite faces at the tip is set at 136°, the indenter is indented by 1 $\mu$m depth to the film. Thereafter the load is decreased, and the indentation depth and load until the load becomes zero are measured.

Figure 4:
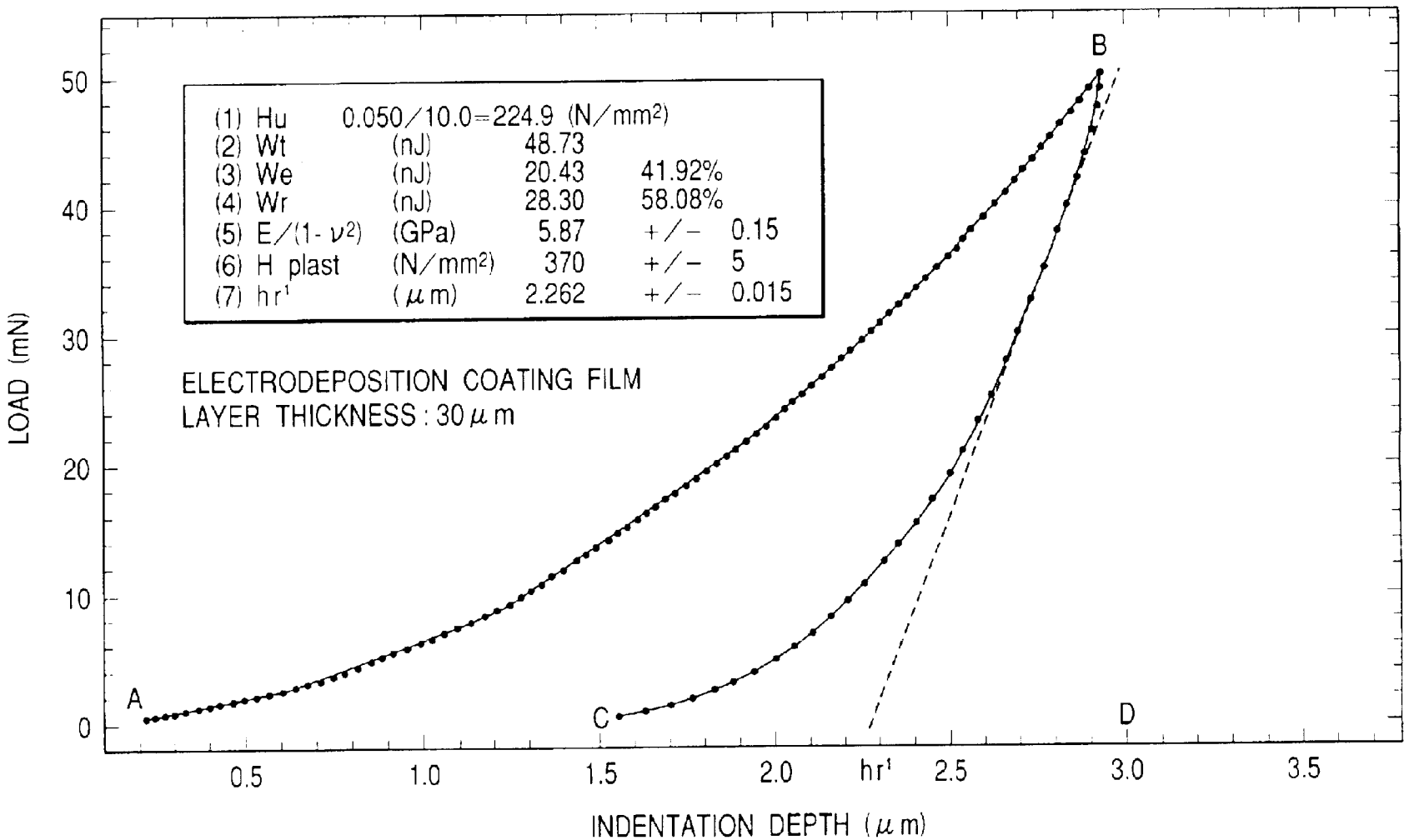
FIG. 4 is a chart of measurement with a Fischer hardness meter at an indentation depth of 3 $\mu$m.

An example where the modulus of elastic deformation is measured with the Fischer hardness meter at an indentation depth of 3 $\mu$m is shown in FIG. 4. A point A is the measurement start point, and a line from A to B is the curve corresponding to the indentation of the indenter. A point B is the point at the time the indentation has reached the maximum preset indentation depth, and a curve of a line from B to C is the curve corresponding to the "return" after the indenter has been indented. Here, the work done We (nJ) for elastic deformation is indicated by the area surrounded by C-B-D-C in FIG. 4, and the work done Wr (nJ) for plastic deformation is indicated by the area surrounded by A-B-C-A in FIG. 4.

The modulus of elastic deformation (We %) in the present invention is expressed by the following expression.

$$We\ \% = [We/(We+Wr)] \times 100$$

In general, the elasticity is the property of an object that enables it to recover its original form when it undergoes a strain (deformation) by external force. What remains as part of strain when the object exceeds its elastic limit or after the external force has been removed under any other influence is the plastic deformation level. Namely, it means that, the larger the value of We % is, the higher the elastic deformation level is, and the smaller the value of We % is, the higher the plastic deformation level is.

If the We % is not more than 30%, it means that the elastic deformation level stands short, and the protective layer may be so brittle as to cause scratches when external additives and so forth of the toner are pressed against the photosensitive layer in the process of image reproduction.

On the other hand, if the We % is not less than 60%, the filming may occur in an environment of high humidity. Details of this have not been elucidated, and it is presumed that a too large elastic deformation level makes various fine particles buried in the protective layer, which are not well scraped off because of a less plastic deformation level, so that the filming occurs making this position the starting point.

The modulus of elastic deformation (We %) measured from the top of the protective layer may more preferably be more than 35% to less than 55%.

The various problems discussed previously may also remarkably occur where any members coming into contact with the electrophotographic photosensitive member touch it more strongly. Accordingly, it is important to satisfy the coefficient of thermal expansion and modulus of elastic deformation as specified above, especially in a system in which the charging means is a contact charging means having a charging member provided in contact with the electrophotographic photosensitive member and this charging member is a member to which only a DC voltage is applied to charge the electrophotographic photosensitive member electrostatically. Further, it is much more important to do so in a system in which charging particles are interposed between the charging member and the electrophotographic photosensitive member.

The protective layer of the electrophotographic photosensitive member according to the present invention may preferably be a layer containing a binder resin and at least one of conductive particles and a charge-transporting material.

As the binder resin for the protective layer, curable resins are preferred. In particular, phenolic resins, epoxy resins and siloxane resins are more preferred. Still in particular, phenolic resins are preferred because the electrical resistance of the protective layer may less undergo environmental variations. Then, particularly more preferred are heat-curable resol type phenolic resins in view of advantages that they can provide a high surface hardness, promise superior wear resistance and also afford superior dispersibility for fine particles and superior stability after their dispersion.

Curable phenolic resins are resin obtained commonly by the reaction of phenolics with formaldehyde.

The phenolic resins have two types, and are divided into a resol type obtained by the reaction of a phenolic with formaldehyde, the latter being used in excess in respect to the former, in the presence of an alkali catalyst, and a novolak type obtained by the reaction of a phenolic with formaldehyde, the former being used in excess in respect to the latter, in the presence of an acid catalyst.

The resol type is soluble in alcohol type solvents and also in ketone type solvents. It undergoes three-dimensionally cross-linking polymerization upon heating, and comes into a cured product. As for the novolak type, it usually does not cure when heated as it is, but forms a cured product upon heating with addition of a formaldehyde source such as paraformaldehyde or hexamethylenetetramine.

Commonly and industrially, the resol type is utilized in coating materials, adhesives, castings and laminating varnishes. The novolak type is chiefly utilized in molding materials and binders.

In the present invention, either of the resol type and the novolak type may be used as the phenolic resins. In view of the ability to cure without addition of any curing agent and the operability as coating materials, it is preferable to use the resol type.

Where the phenolic resins are used in the present invention, any of phenolic resins may be used alone or in the form of a mixture of two or more. It is also possible to use the resol type and the novolak type in combination. Also, any known phenolic resins may be used.

Resol type phenolic resins are usually produced by reacting phenolic compounds with aldehyde compounds in the presence of an alkali catalyst.

Chief phenolic compounds to be used may include, but are not limited to, phenol, cresol, xylenol, para-alkylphenols, para-phenylphenol, resorcin and bisphenols. The aldehyde compounds may also include, but are not limited to, formaldehyde, paraformaldehyde, furfural and acetaldehyde.

These phenolic compounds and aldehyde compounds may be allowed to react in the presence of an alkali catalyst to produce any of monomers of monomethylolphenols, dimethylolphenols or trimethylolphenols, mixtures of these, or those obtained by making them into oligomers, and mixtures of these monomers and oligomers. Of these, relatively large molecules having about 2 to 20 repeating units of molecular structure are the oligomers, and those having a single unit are the monomers.

The alkali catalyst to be used may include metal type alkali compounds and amine compounds. The metal type alkali compounds may include, but are not limited to, alkali metal or alkaline earth metal hydroxides such as sodium hydroxide, potassium hydroxide and calcium hydroxide. The amine compounds may include, but are not limited to, ammonia, hexamethylenetetramine, trimethylamine, triethylamine and triethanolamine.

In the present invention, taking account of variations of electrical resistance in an environment of high humidity, amine compounds may preferably be used, and, taking account of other electrophotographic performances, may also be used in the form of a mixture with any of the metal type alkali compounds.

The protective layer of the electrophotographic photosensitive member according to the present invention may preferably be formed by coating on the photosensitive layer a coating solution prepared by dissolving the curable phenolic resin in, or diluting it with, a solvent or the like, whereby polymerization reaction takes place upon heating after coating and a cured layer is formed. The form of polymerization is that the reaction proceeds by addition and condensation caused by heating, where the protective layer is formed by coating, followed by heating to cause polymerization reaction to take place to form a polymeric cured layer in which the resin has cured.

Incidentally, in the present invention, what is meant by "the resin has cured" is that resin stands insoluble even when the resin is wetted with an alcohol solvent such as methanol or ethanol.

The conductive particles for the protective layer have an auxiliary function to control the volume resistivity of the protective layer, and need not necessarily be used if unnecessary.

The conductive particles usable in the protective layer of the electrophotographic photosensitive member according to the present invention may include metal particles and metal oxide particles.

The metal particles may include aluminum, zinc, copper, chromium, nickel, silver and stainless steel particles, or particles of plastic on the surfaces of which any of these metals has been vacuum-deposited. The metal oxide particles may include zinc oxide, titanium oxide, tin oxide, antimony oxide, indium oxide, bismuth oxide, tin-doped indium oxide, antimony- or tantalum-doped tin oxide, and antimony-doped zirconium oxide particles.

Any of these may be used alone or may be used in combination of two or more types. When used in combination of two or more types, they may merely be blended or may be made into a solid solution or a fused solid.

In the present invention, among the conductive particles described above, the use of metal oxides is preferred in view of the transparency. Of these metal oxides, the use of tin oxide is further particularly preferred. The tin oxide may be, for the purpose of improving dispersibility and liquid stability, one having been subjected to surface treatment described later, or may be, for the purpose of improving resistance controllability, one having been doped with antimony or tantalum.

The conductive particles for the protective layer may preferably have an average particle diameter of 0.3 $\mu$m or less, and-particularly 0.1 $\mu$m or less, from the viewpoint of transparency of the protective layer. On the other hand, from the viewpoint of dispersibility and dispersion stability, they may preferably have an average particle diameter of 0.001 $\mu$m or more.

From the viewpoint of film strength of the protective layer, the protective layer comes weaker with an increase in the quantity of the conductive particles. Accordingly, the conductive particles may preferably be in a small quantity as long as the volume resistivity and residual potential of the protective layer are tolerable.

The protective layer of the electrophotographic photosensitive member according to the present invention may also preferably be a layer containing lubricating particles The lubricating particles for the protective layer may preferably include fluorine-atom-containing resin particles, silicone resin particles, silica particles and alumina particles, and more preferably be fluorine-atom-containing resin particles. Also, two or more kinds of these may be blended.

The fluorine-atom-containing resin particles may include particles of tetrafluoroethylene resin, trifluorochloroethylene resin, hexafluoroethylene propylene resin, vinyl fluoride resin, vinylidene fluoride resin, difluorodichloroethylene resin and copolymers of these, any one or more of which may preferably appropriately be selected. Tetrafluoroethylene resin particles and vinylidene fluoride resin particles are particularly preferred.

The molecular weight and particle diameter of the lubricating particles may appropriately be selected, without any particular limitations. Preferably, they may have a molecular weight of from 3,000 to 5,000,000, and an average particle diameter of from 0.01 $\mu$m to 10 $\mu$m, and more preferably from 0.05 $\mu$m to 2.0 $\mu$m.

Inorganic particles such as silica particles and alumina particles do not function as the lubricating particles as particles alone in some cases. However, studies made by the present inventors have revealed that the dispersing and adding of these can make the protective layer have a larger surface roughness, and consequently can make the protective layer have an improved lubricity. In the present invention, the lubricating particles are meant to include particles capable of providing lubricity.

When the conductive particles and the lubricating particles such as fluorine-atom-containing resin particles are dispersed together in a resin solution, in order to make these particles not undergo mutual agglomeration, the fluorine-atom-containing compound may be added at the time the conductive particles are dispersed, or the conductive particles may be surface-treated with the fluorine-containing compound.

Compared with a case in which any fluorine-atom-containing compound is not added, the addition of the fluorine-atom-containing compound to the conductive particles or the surface treatment of the latter with the former brings about a dramatic improvement in dispersibility and dispersion stability of the conductive particles and fluorine-atom-containing resin particles in the resin solution.

The fluorine-atom-containing resin particles may also be dispersed in a liquid dispersion in which the fluorine-atom-containing compound has been added and the conductive particles have been dispersed, or in a liquid dispersion in which the surface-treated conductive particles have been dispersed. This enables preparation of a protective-layer coating fluid free of any formation of secondary particles of dispersed particles, very stable with time and having a good dispersion.

The fluorine-atom-containing compound may include fluorine-containing silane coupling agents, fluorine-modified silicone oils and fluorine type surface-active agents. Examples of preferred compounds are given below. In the present invention, examples are by no means limited to these compounds.

Examples of fluorine-containing silane coupling agents $CF_3CH_2CH_2Si(OCH_3)_3$
$C_4F_9CH_2CH_2Si(OCH_3)_3$
$C_6F_{13}CH_2CH_2Si(OCH_3)_3$
$C_8F_{17}CH_2CH_2Si\ (OCH_3)_3$
$C_8F_{17}CH_2CH_2Si(OCH_2CH_2OCH_3)_3$
$C_{10}F_{21}Si(OCH_3)_3$
$C_6F_{13}CONHSi(OCH_3)_3$
$C_8F_{17}CONHSi(OCH_3)_3$
$C_7F_{15}CONHCH_2CH_2CH_2Si(OCH_3)_3$
$C_7F_{15}CONHCH_2CH_2CH_2Si(OC_2H_5)_3$
$C_7F_{15}COONHCH_2CH_2CH_2Si(OCH_3)_3$
$C_7F_{15}COSNHCH_2CH_2CH_2Si(OCH_3)_3$
$C_7F_{15}SO_2NHCH_2CH_2CH_2Si(OC_2H_5)_3$ $$C_8F_{17}SO_2\underset{\underset{CH_2CH_2CH_3}{|}}{N}CH_2CH_2CH_2Si(OCH_3)_3$$

$C_8F_{17}CH_2CH_2SCH_2CH_2Si(OCH_3)_3$
$C_{10}F_{21}CH_2CH_2SCH_2CH_2Si(OCH_3)_3$ $$C_7F_{15}CONHCH_2CH_2\underset{\underset{COC_7F_{15}}{|}}{N}CH_2CH_2CH_2Si(OCH_3)_3$$

$$C_7F_{15}SO_2NHCH_2CH_2\underset{\underset{SO_2C_8F_{17}}{|}}{N}CH_2CH_2CH_2Si(OCH_3)_3$$

-continued

Examples of fluorine-modified silicone oils

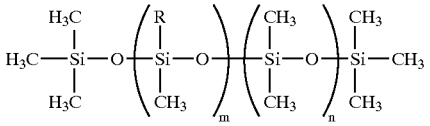

R: $—CH_2CH_2CF_3$
m and n: positive integers
Examples of fluorine type surface-active agents $X—SO_2NRCH_2COOH$
$X—SO_2NRCH_2CH_2O(CH_2CH_2O)_nH$
$X—SO_2N(CH_2CH_2CH_2OH)_2$
$X—RO(CH_2CH_2O)_nH$
$X—(RO)_nH$
$X—(RO)_nR$

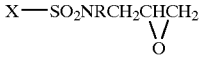

X—COOH, $X—CH_2CH_2COOH$
X—ORCOOH
$X—ORCH_2COOH$, $X—SO_3H$
$X—ORSO_3H$, $X—CH_2CH_2OH$

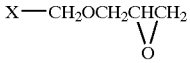

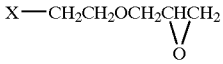

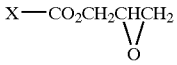

R: alkyl group, aryl group or aralkyl group
X: fluorocarbon group such as $—CF_3$, $—C_4F_8$ or $—C_8F_{17}$.
n: 5, 10 or 15

As a method for the surface treatment of the conductive particles, the conductive particles and the surface-treating agent may be mixed and dispersed in a suitable solvent to make the surface-treating agent adhere to the conductive-particle surfaces. They may be dispersed by using a usual dispersion means such as a ball mill or a sand mill. Next, the solvent may be removed from the resultant liquid dispersion to make the surface-treating agent fix to the conductive-particle surfaces.

After this treatment, heat treatment may further optionally be made. Also, in the surface-treating dispersion, a catalyst for accelerating the reaction may be added. Still also, the conductive particles having been surface-treated may further optionally be subjected to pulverization treatment.

The proportion of the fluorine-atom-containing compound to the conductive particles is influenced by the particle diameter, shape and surface area of the particles to be treated, and the former may preferably be in an amount of from 1 to 65% by weight, and more preferably from 1 to 50% by weight, based on the total weight of the latter conductive particles having been surface-treated.

In the present invention, in order to provide a protective layer having a higher environmental stability, a siloxane compound having structure represented by the following Formula (1) may further be added at the time the conductive particles are dispersed, or conductive particles having been surface-treated with the siloxane compound having structure represented by the following Formula (1) may further be mixed. This enables formation of the protective layer having much higher environmental stability.

(1)

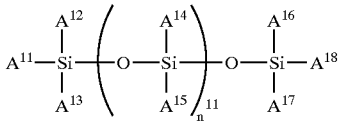

In Formula (1), $A^{11}$ to $A^{18}$ are each independently a hydrogen atom or a methyl group, provided that the proportion of the total number (b) of the hydrogen atoms in the total number (a) of A's, b/a, ranges from 0.001 or more to 0.5 or less; and $n^{11}$ is an integer of 0 or more.

This siloxane compound may be added to the conductive particles, followed by dispersion, or conductive metal oxide particles surface-treated with this siloxane compound may be dispersed in a binder resin dissolved in a solvent. This enables preparation of a protective-layer coating fluid free of any formation of secondary particles of dispersed particles, more stable with time and having a better dispersion. Also, the protective layer formed using such a coating fluid can have a high transparency, and a film having especially good environmental resistance can be obtained.

There are no particular limitations on the molecular weight of the siloxane compound having structure represented by the above Formula (1). However, when the conductive particles are surface-treated with it, it is better for the compound not to have too a high viscosity in view of the readiness of surface treatment. It may preferably have a weight-average molecular weight of from 100 to 50,000, and particularly preferably from 500 to 10,000 in view of treatment efficiency for the surface treatment.

As methods for the surface treatment, there are two methods, a wet process and a dry process.

In the wet-process treatment, the conductive particles conductive metal oxide particles and the siloxane compound having structure represented by Formula (1) are dispersed in a solvent to make the siloxane compound adhere to the particle surfaces.

As a dispersion means, they may be dispersed by using a usual dispersion means such as a ball mill or a sand mill. Next, this dispersion is made to fix to the conductive-particle surfaces by heat treatment. In this heat treatment, Si—H bonds in siloxane undergo oxidation of hydrogen atoms which is caused by the oxygen in air in the course of the heat treatment to form additional siloxane linkages. As the result, the siloxane develops to come to have a three-dimensional network structure, and the conductive-particle surfaces are covered with this network structure. Thus, the surface treatment is completed upon making the siloxane compound fix to the conductive-particle surfaces. The particles having been thus treated may optionally be subjected to pulverization treatment.

In the dry-process treatment, the siloxane compound and the conductive metal oxide particles are mixed without use of any solvent, followed by kneading to make the siloxane compound adhere to the particle surfaces. Thereafter, like the case of the wet-process treatment, the resultant particles may be subjected to heat treatment and pulverization treatment to complete the surface treatment.

As the charge-transporting material usable in the protective layer of the electrophotographic photosensitive member according to the present invention, a compound having at least one hydroxyl group in the molecule is preferred. In particular, a compound having at least one hydroxyalkyl group, hydroxyalkoxyl group or hydroxyphenyl group in the molecule is preferred.

As a charge-transporting material having at least one of a hydroxyalkyl group and a hydroxyalkoxyl group in the molecule, a charge-transporting material having structure represented by any of the following Formulas (2) to (4) is preferred.

(2)

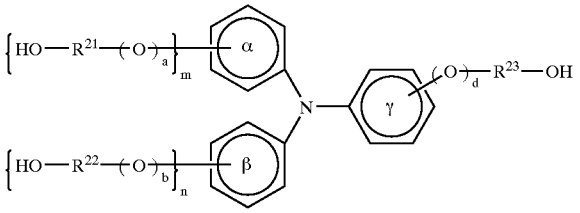

In Formula (2), $R^{21}$, $R^{22}$ and $R^{23}$ each independently represent a divalent hydrocarbon group having 1 to 8 carbon atoms and which may be branched. The benzene rings α, β and γ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols a, b, d, m and n each independently represent 0 or 1.

(3)

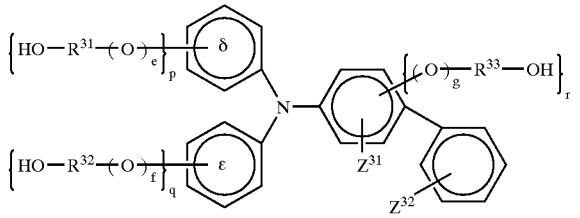

In Formula (3), $R^{31}$, $R^{32}$ and $R^{33}$ each independently represent a divalent hydrocarbon group having 1 to 8 carbon atoms and which may be branched. The benzene rings δ and ϵ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols e, f and g each independently represent 0 or 1. Letter symbols p, q and r each independently represent 0 or 1, provided that a case in which all of them are simultaneously 0 is excluded. $Z^{31}$ and $Z^{32}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

(4)

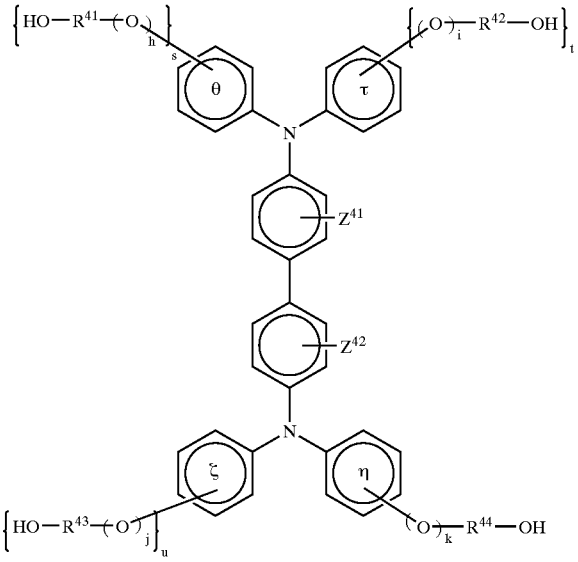

In Formula (4), $R^{41}$, $R^{42}$, $R^{43}$ and $R^{44}$ each independently represent a divalent hydrocarbon group having 1 to 8 carbon atoms and which may be branched. The benzene rings ζ, η, θ and ι may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols h, i, j, k, s, t and u each independently represent 0 or 1. $Z^{41}$ and $Z^{42}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

As a charge-transporting material having a hydroxyphenyl group in the molecule, a charge-transporting material having structure represented by any of the following Formulas (5) to (7) is preferred.

(5)

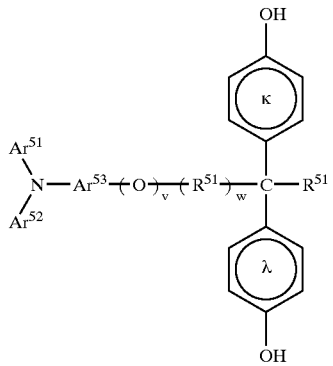

In Formula (5), $R^{51}$ represents a divalent hydrocarbon group having 1 to 8 carbon atoms and which may be branched. $R^{52}$ represents a hydrogen atom, a substituted or unsubstituted alkyl group, a substituted or unsubstituted aralkyl group or a substituted or unsubstituted phenyl group. $Ar^{51}$ and $Ar^{52}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. $Ar^{53}$ represents a substituted or unsubstituted divalent aromatic hydrocarbon ring group or a substituted or unsubstituted divalent aromatic heterocyclic group. Letter symbols v and w each independently represent 0 or 1, provided that w is 0 when v is 0. The benzene rings κ and λ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group.

(6)

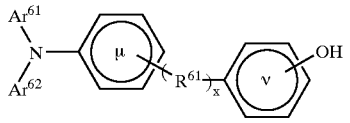

In Formula (6), $R^{61}$ represents a divalent hydrocarbon group having 1 to 8 carbon atoms and which may be branched. $Ar^{61}$ and $Ar^{62}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. Letter symbol x represents 0 or 1. The benzene rings μ and ν may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings μ and ν may combine via a substituent to form a ring.

(7)

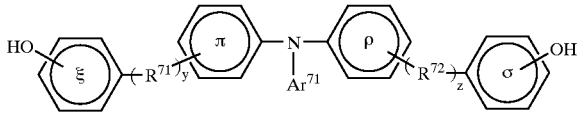

In Formula (7), $R^{71}$ and $R^{72}$ each independently represent a divalent hydrocarbon group having 1 to 8 carbon atoms and which may be branched. $Ar^{71}$ represents a substituted or unsubstituted alkyl group, a substituted or unsubstituted aralkyl group, a substituted or unsubstituted aromatic hydrocarbon ring group or a substituted or unsubstituted aromatic heterocyclic group. Letter symbols y and z each independently represent 0 or 1. The benzene rings ξ, π, ρ and σ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. The benzene rings ξ and π and the benzene rings ρ and σ may each independently combine via a substituent to form a ring.

In the above formulas (2) to (7), the divalent hydrocarbon groups represented by $R^{21}$, $R^{22}$, $R^{23}$, $R^{31}$, $R^{32}$, $R^{33}$, $R^{41}$, $R^{42}$, $R^{43}$, $R^{44}$, $R^{51}$, $R^{61}$, $R^{71}$ and $R^{72}$, having 1 to 8 carbon atoms and which may be branched, may include alkylene groups such as a methylene group, an ethylene group, a propylene group and a butylene group, an isopropylene group, and a cyclohexylidene group.

The alkyl group represented by $R^{52}$ may include a methyl group, an ethyl group, a propyl group and a butyl group; and the aralkyl group may include a benzyl group, a phenethyl group and a naphthylmethyl group.

Of the substituents the benzene rings α, β, γ, δ, ε, ζ, η, θ, ι, κ, λ, μ, ν, ξ, π, ρ and σ may have, the halogen atom may include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

In the cases in which the benzene rings μ and ν, the benzene rings ξ and π and the benzene rings ρ and σ each combine via a substituent to form a ring, the substituent may include a propylidene group and an ethylene group. Via such groups, cyclic structures such as a fluorene skeleton and a dihydrophenanthrene skeleton are formed.

The halogen atoms represented by $Z^{31}$, $Z^{32}$, $Z^{41}$ and $Z^{42}$ may also include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The alkyl groups represented by $Ar^{51}$, $Ar^{52}$, $Ar^{61}$, $Ar^{62}$ and $Ar^{71}$ may also include a methyl group, an ethyl group, a propyl group and a butyl group; the aralkyl group may include a benzyl group, a phenethyl group and a naphthylmethyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The divalent aromatic hydrocarbon ring group represented by $Ar^{53}$ may include a phenylene group, a naphthylene group, an anthrylene group and a pyrenylene group; and the divalent aromatic heterocyclic group may include a pyridilene group and a thienylene group.

The substituents the above groups may have may include alkyl groups such as a methyl group, an ethyl group, a propyl group and a butyl group; aralkyl groups such as a benzyl group, a phenethyl group and a naphthylmethyl group; aromatic hydrocarbon ring groups and aromatic heterocyclic groups such as a phenyl group, a naphthyl group, an anthryl group, a pyrenyl group, a fluorenyl group, a carbazolyl group, a dibenzofuryl group and a benzothiophenyl; alkoxyl groups such as a methoxyl group, an ethoxyl group and a propoxyl group; aryloxyl groups such as a phenoxyl group and a naphthoxyl group; halogen atoms such as a fluorine atom, a chlorine atom, a bromine atom and an iodine atom; and a nitro group and a cyano group.

The charge-transporting material having structure represented by any of the above Formulas (2) to (7) has a good compatibility with the phenolic resin, and films of protective layers in which it has uniformly been dispersed can be produced with ease.

In order to more improve the compatibility, the divalent hydrocarbon groups represented by $R^{21}$, $R^{22}$, $R^{23}$, $R^{31}$, $R^{32}$, $R^{33}$, $R^{41}$, $R^{42}$, $R^{43}$ and $R^{44}$ in the above Formulas (2) to (4)

may preferably be those having 4 or less carbon atoms, and also the number of the hydroxylalkyl group and hydroxylalkoxyl group may preferably be two or more.

In the charge-transporting material having structure represented by any of the above Formulas (5) to (7), the hydroxyphenyl group contained therein reacts with the phenolic resin, and the charge-transporting material is incorporated in the matrix of the protective layer, so that the layer can have a higher strength as the protective layer.

The charge-transporting material having structure represented by any of the above Formulas (2) to (7) is uniformly dissolved or dispersed in a coating fluid for producing the protective layer, and the coating fluid is coated to form the protective layer.

The charge-transporting material having structure represented by any of the above Formulas (2) to (7) and the binder resin may preferably be mixed in a proportion of charge-transporting material/binder resin=0.1/10 to 20/10, and particularly preferably 0.5/10 to 10/10. If the charge-transporting material is in a too small quantity in respect to the binder resin, the effect of lowering the residual potential may be small. If it is in a too large quantity, the protective layer may have a low strength.

Examples of the charge-transporting material having structure represented by any of the above Formulas (2) to (7) are shown below. Note that the present invention is by no means limited to these.

| No. | Exemplary Compounds |
|---|---|
| 1 | 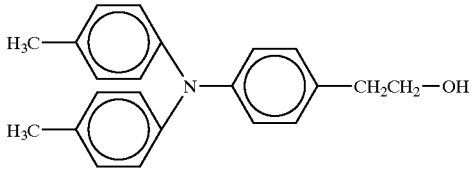 |
| 2 | 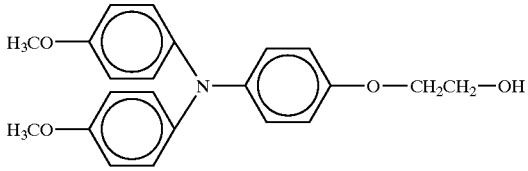 |
| 3 | 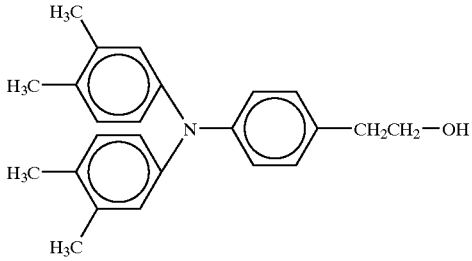 |
| 4 | 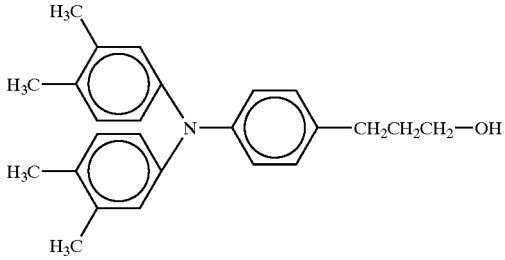 |
| 5 | 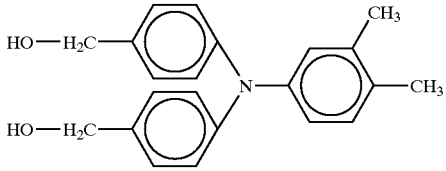 |

-continued
| No. | Exemplary Compounds |
|---|---|
| 6 | 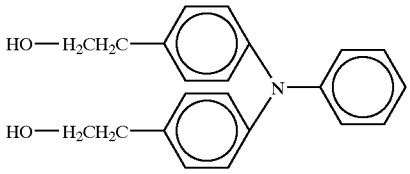 |
| 7 | 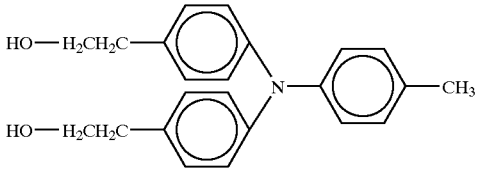 |
| 8 | 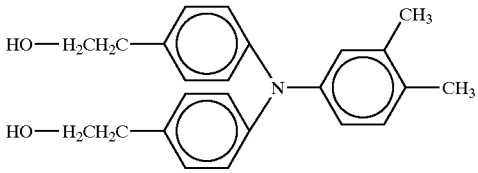 |
| 9 | 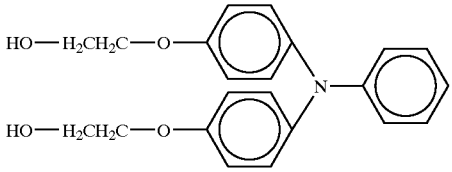 |
| 10 | 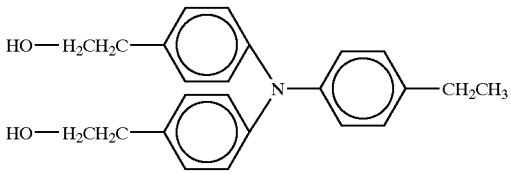 |
| 11 | 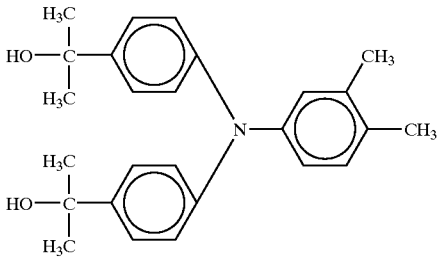 |
| 12 | 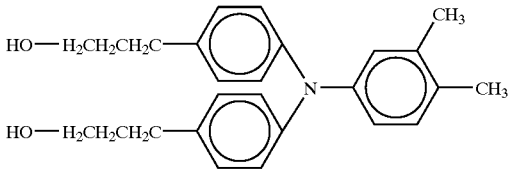 |
| 13 | 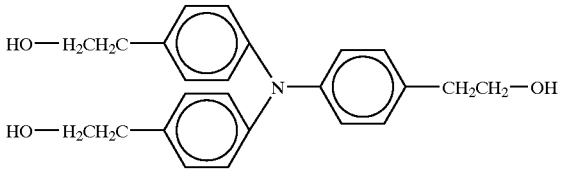 |

-continued
| No. | Exemplary Compounds |
|---|---|
| 14 | 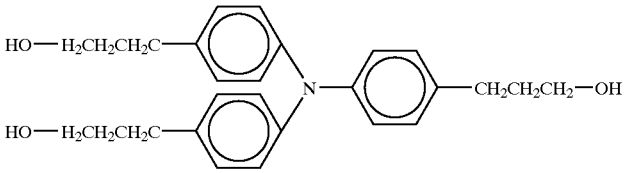 |
| 15 | 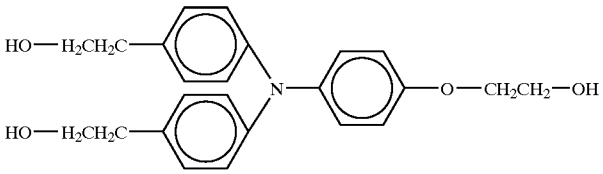 |
| 16 | 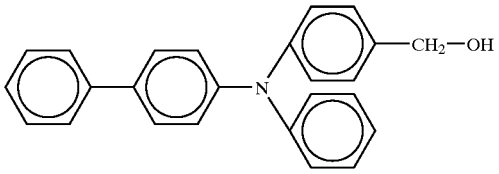 |
| 17 | 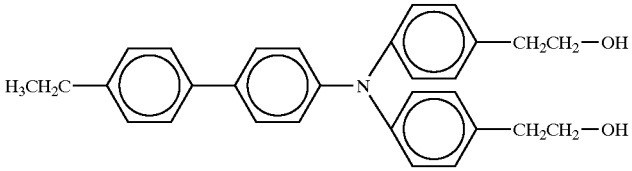 |
| 18 | 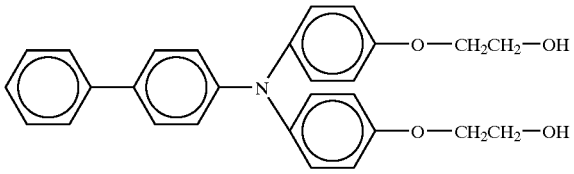 |
| 19 | 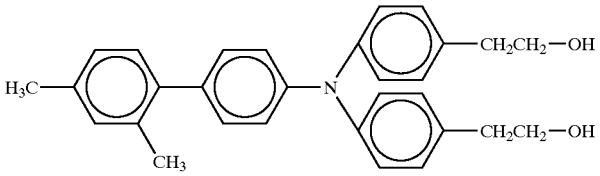 |
| 20 | 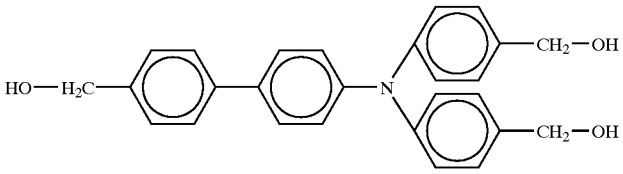 |
| 21 | 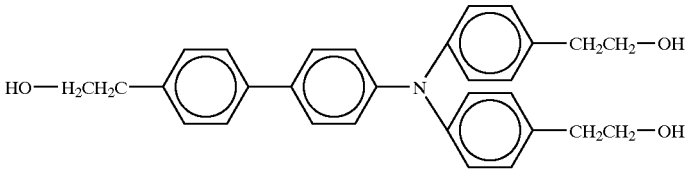 |

-continued
| No. | Exemplary Compounds |
|---|---|
| 22 | 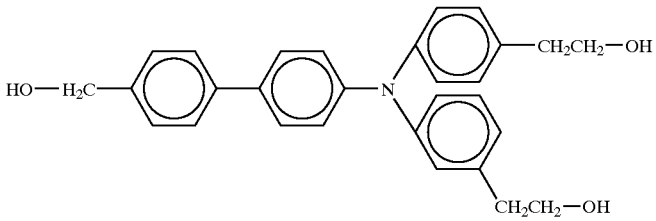 |
| 23 | 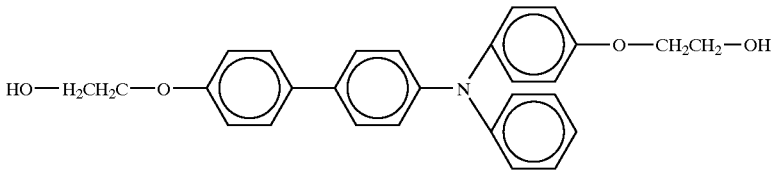 |
| 24 | 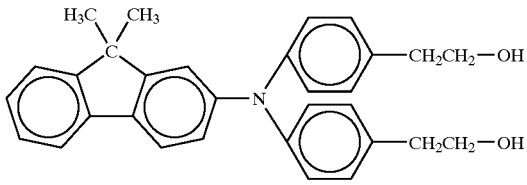 |
| 25 | 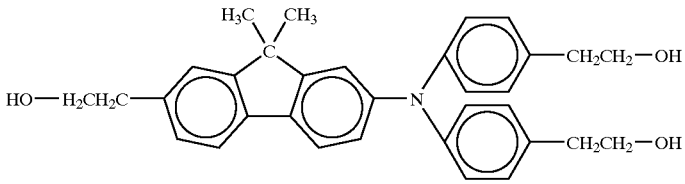 |
| 26 | 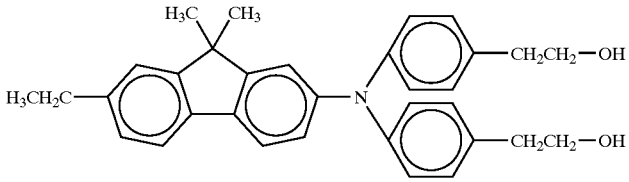 |
| 27 | 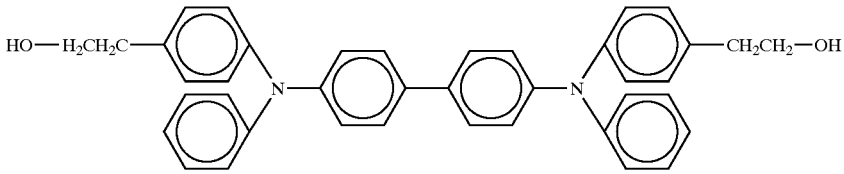 |
| 28 | 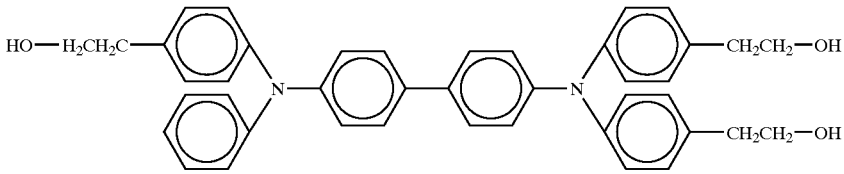 |
| 29 | 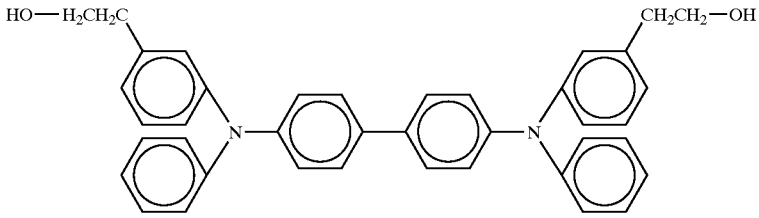 |

-continued
| No. | Exemplary Compounds |
|---|---|
| 30 | 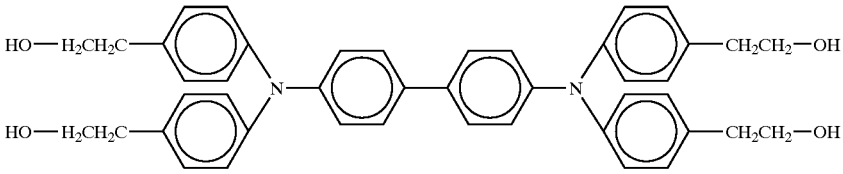 |
| 31 | 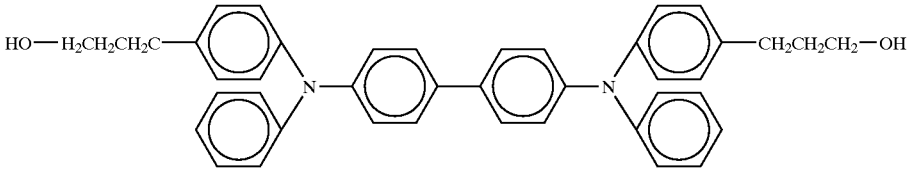 |
| 32 | 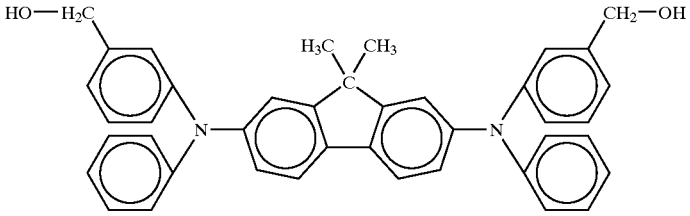 |
| 33 | 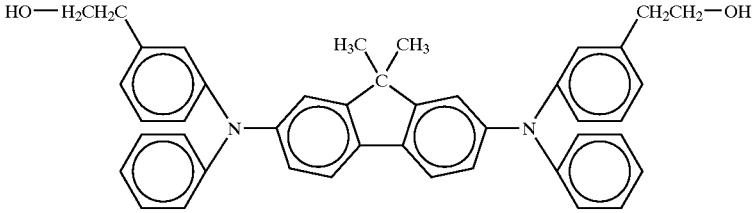 |
| 34 | 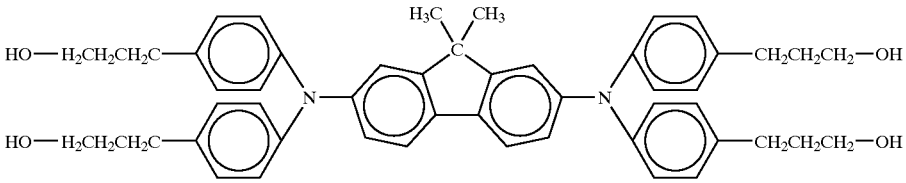 |
| 35 | 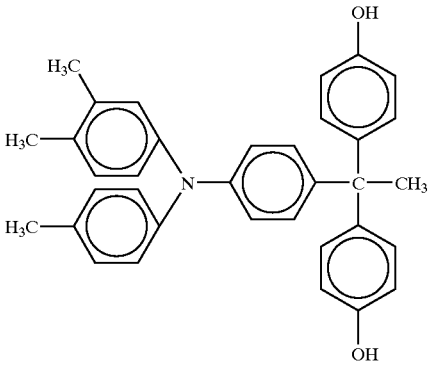 |

-continued
| No. | Exemplary Compounds |
|---|---|
| 36 | 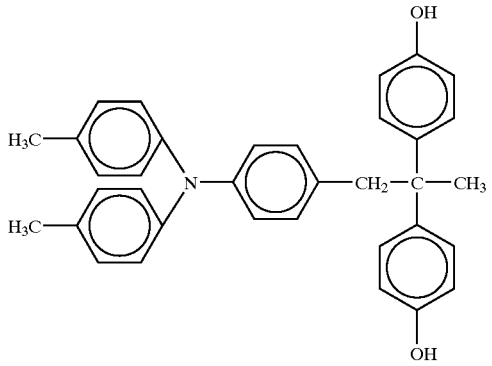 |
| 37 | 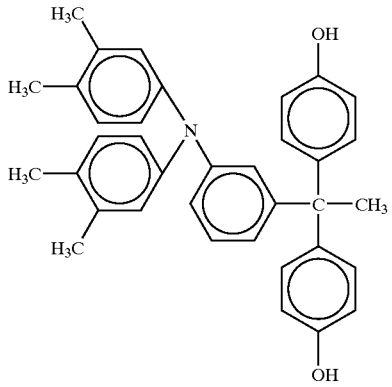 |
| 38 | 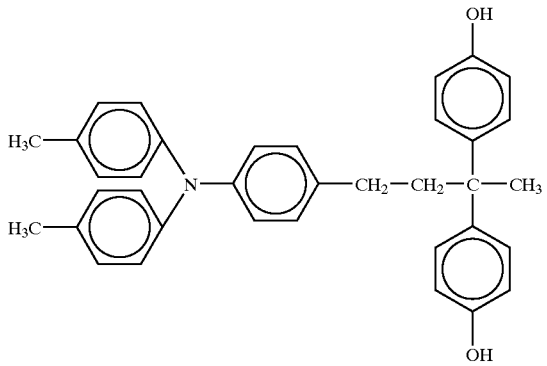 |
| 39 | 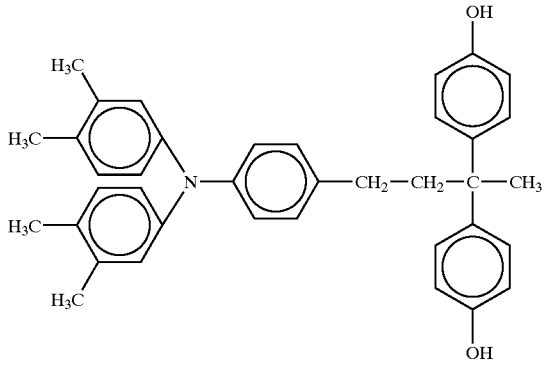 |

-continued
| No. | Exemplary Compounds |
|---|---|
| 40 | 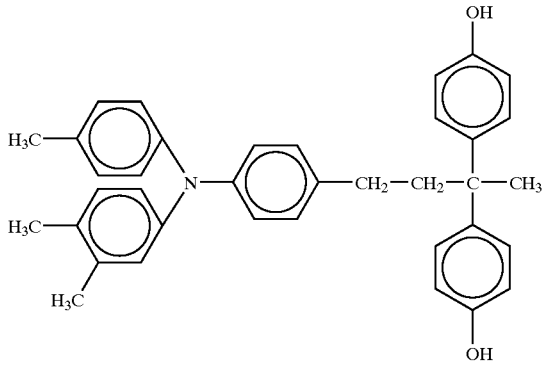 |
| 41 | 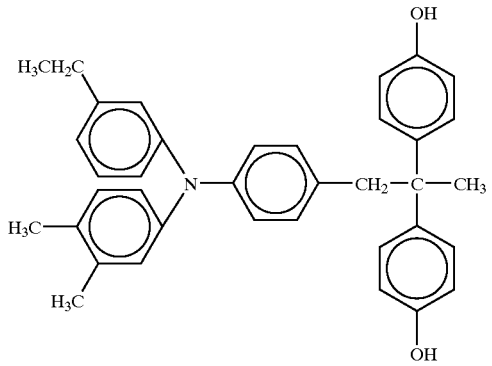 |
| 42 | 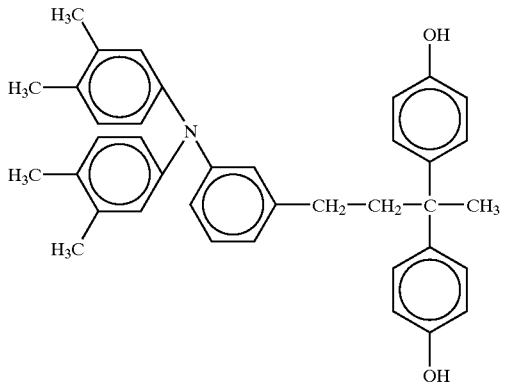 |
| 43 | 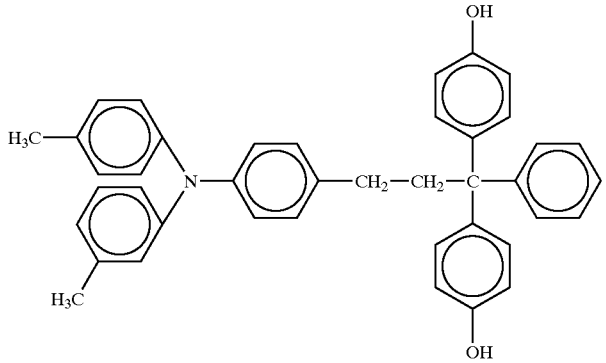 |

-continued
| No. | Exemplary Compounds |
|---|---|
| 44 | 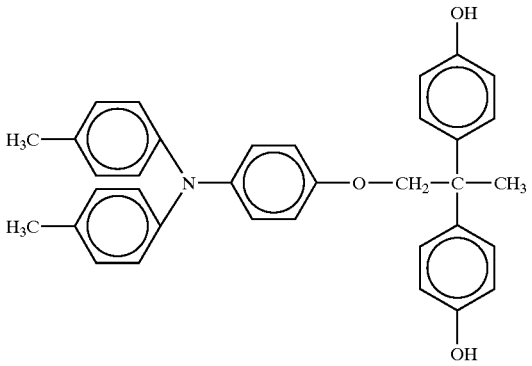 |
| 45 | 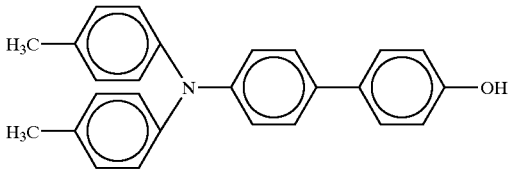 |
| 46 | 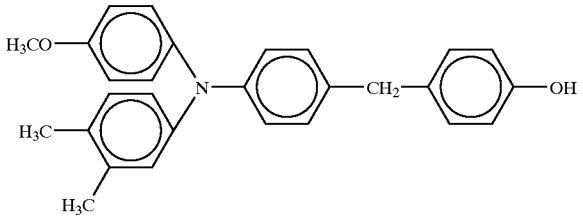 |
| 47 | 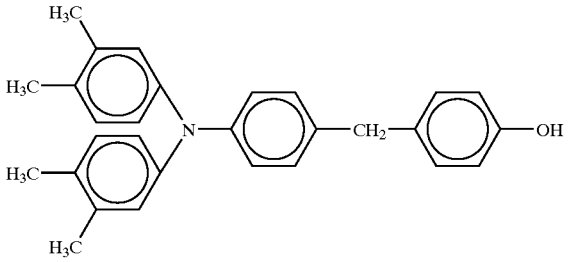 |
| 48 | 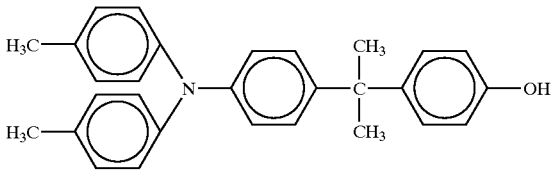 |
| 49 | 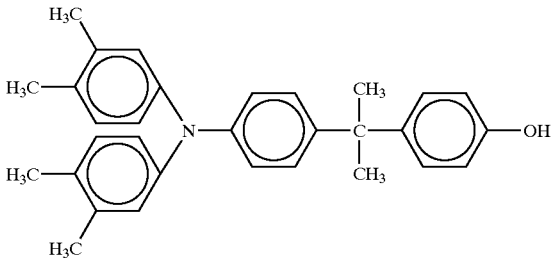 |

-continued
| No. | Exemplary Compounds |
|---|---|
| 50 | 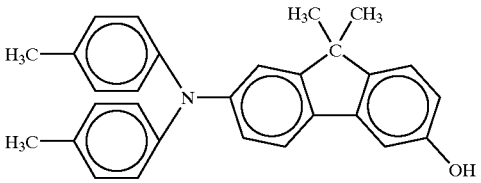 |
| 51 | 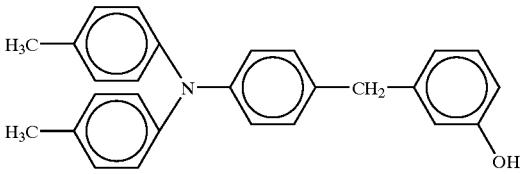 |
| 52 | 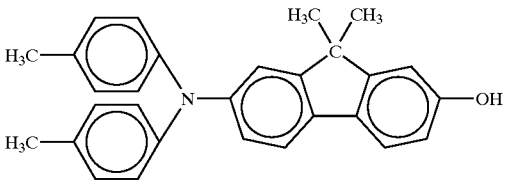 |
| 53 | 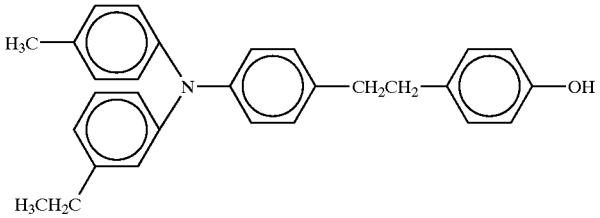 |
| 54 | 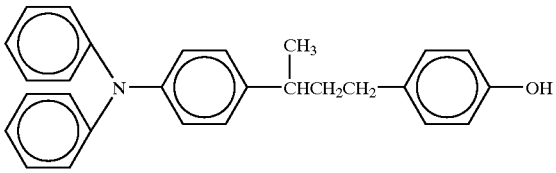 |
| 55 | 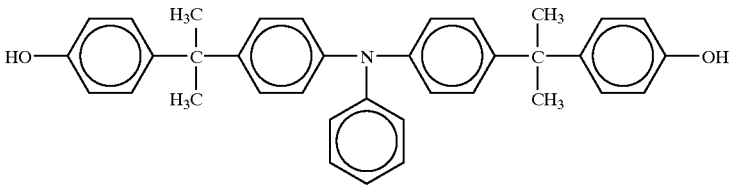 |
| 56 | 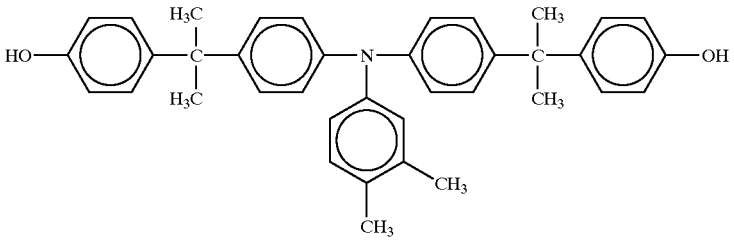 |

-continued

| No. | Exemplary Compounds |
|---|---|
| 57 | 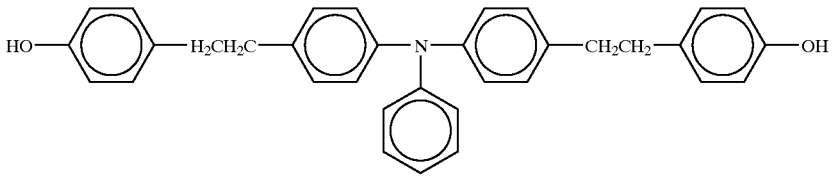 |
| 58 | 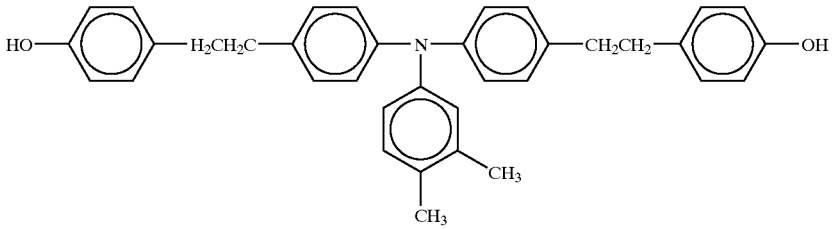 |
| 59 | 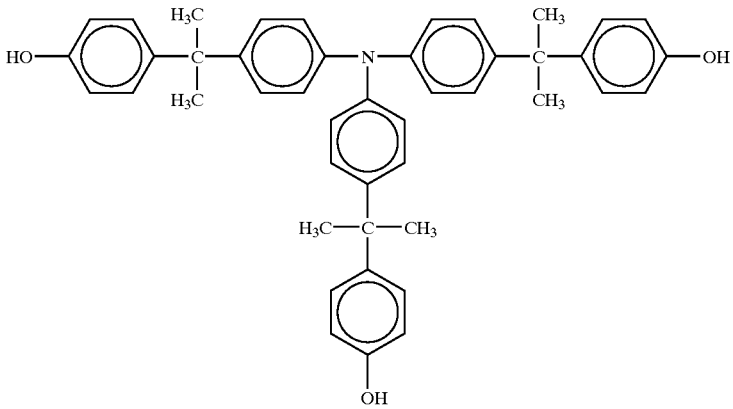 |
| 60 | 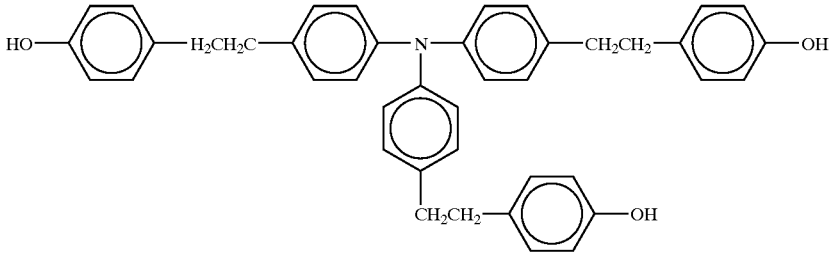 |

Of these, Exemplary Compounds (3), (4), (5), (8), (11), (12), (13), (17), (21), (24), (25), (26), (27), (28), (30), (31), (34), (35)1, (39), (44), (48), (49), (50), (52), (55), (56), (58) and (59) are preferred. Further, Exemplary Compounds (3), (8), (12), (25), (31), (39), (44), (49) and (56) are more preferred.

As the solvent in which the components for the protective layer coating fluid are to be dissolved or dispersed, a solvent is preferable which dissolves the binder resin sufficiently, sufficiently dissolves also the charge-transporting material having structure represented by any of the above Formulas (2) to (7), affords good dispersibility for the conductive particles where such particles are used, has good compatibility with and good treating performance for the lubricating particles such as the fluorine-atom-containing compound, the fluorine-atom-containing resin particles and the siloxane compound where such particles are used, and also does not adversely affect the charge transport layer with which the coating fluid for the protective layer is to come into contact.

Accordingly, usable as the solvent are alcohols such as methanol, ethanol and 2-propanol, ketones such as acetone and methyl ethyl ketone, esters such as methyl acetate and ethyl acetate, ethers such as tetrahydrofuran and dioxane, aromatic hydrocarbons such as toluene and xylene, and halogen type hydrocarbons such as chlorobenzene and dichloromethane, any of which may further be used in the form of a mixture. Of these, solvents most preferable for the form of the phenolic resin are alcohols such as methanol, ethanol and 2-propanol.

Conventional charge-transporting materials are commonly insoluble or slightly soluble in alcohol type solvents, and are uniformly dispersible with difficulty in common phenolic resins. However, many of the charge-transporting materials used in the present invention are soluble in solvents composed chiefly of alcohols, and hence can be dispersed in the solvent in which the phenolic resin is dissolved.

The protective layer of the electrophotographic photosensitive member according to the present invention may be formed by any coating method commonly used, such as dip coating, spray coating, spinner coating, roller coating, Meyer bar coating and blade coating.

The protective layer of the electrophotographic photosensitive member according to the present invention may preferably have a layer thickness within the range of from 0.1 μm to 10 μm, and more preferably from 0.5 μm to 7 μm, because any too thin protective layer may damage the running performance of the electrophotographic photosensitive member and on the other hand any too thick protective layer may cause a rise of residual potential due to such a layer provided.

In the present invention, additives such as an antioxidant may be incorporated in the protective layer in order to prevent the surface layer from deteriorating because of adhesion of active substances such as ozone and nitrogen oxides generated at the time of charging.

The photosensitive layer is described below.

Figure 1B:
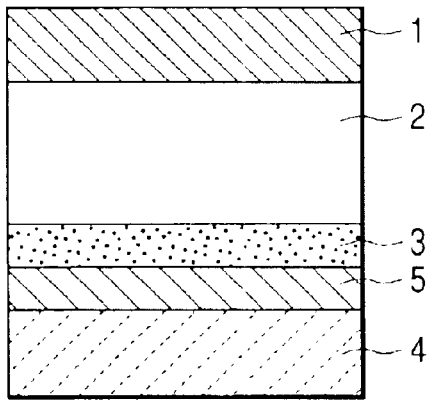
Figure 1C:
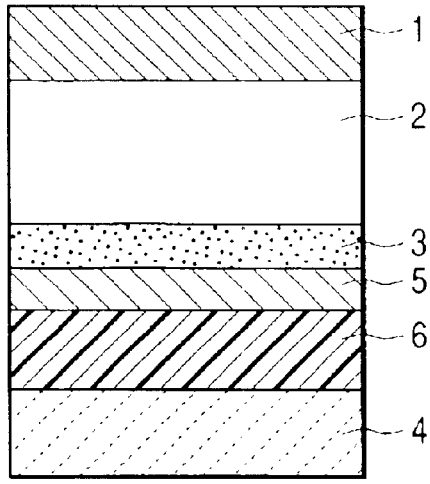

The photosensitive layer of the present invention may preferably have a multilayer structure. FIGS. 1A to 1C show examples thereof. The electrophotographic photosensitive member shown in FIG. 1A comprises a support 4 and provided thereon a charge generation layer 3 and a charge transport layer 2 in this order, and a protective layer 1 further provided on the outermost surface. As shown in FIGS. 1B and 1C, an intermediate layer 5 and also a conductive layer 6 aiming at prevention of interference fringes may further be provided between the support and the charge generation layer.

As the support of the electrophotographic photosensitive member of the present invention, it may be one having conductivity and an outer diameter of less than 30 mm. For example, usable are supports made of a metal such as aluminum, aluminum alloy or stainless steel, and besides supports having layers film-formed by vacuum deposition of aluminum, aluminum alloy or indium oxide-tin oxide alloy, supports comprising plastic or paper impregnated with conductive fine particles (e.g., carbon black, tin oxide, titanium oxide or silver particles) together with a suitable binder resin, and plastics having a conductive binder resin.

An intermediate layer (an adhesion layer) having the function as a barrier and the function of adhesion may be provided between the support and the photosensitive layer. The intermediate layer is formed for the purposes of, e.g., improving the adhesion of the photosensitive layer, improving coating performance, protecting the support, covering any defects of the support, improving the injection of electric charges from the support and protecting the photosensitive layer from any electrical breakdown. The intermediate layer may be formed of, e.g., casein, polyvinyl alcohol, ethyl cellulose, an ethylene-acrylic acid copolymer, polyamide, modified polyamide, polyurethane, gelatin or aluminum oxide. The intermediate layer may preferably have a layer thickness of 0.5 μm or less, and more preferably from 0.1 μm to 3 μm.

The charge-generating material used in the electrophotographic photosensitive member of the present invention may include:

(1) azo pigments such as monoazo, disazo and trisazo;
(2) phthalocyanine pigments such as metal phthalocyanines and metal-free phthalocyanine;
(3) indigo pigments such as indigo and thioindigo;
(4) perylene pigments such as perylene acid anhydrides and perylene acid imides;
(5) polycyclic quinone pigments such as anthraquinone and pyrenequinone;
(6) squarilium dyes;
(7) pyrylium salts and thiapyrylium salts;
(8) triphenylmethane dyes;
(9) inorganic materials such as selenium, selenium-tellurium and amorphous silicon;
(10) quinacridone pigments;
(11) azulenium salt pigments;
(12) cyanine dyes;
(13) xanthene dyes;
(14) quinoneimine dyes;
(15) styryl dyes;
(16) cadmium sulfide; and
(17) zinc oxide.

Of these, phthalocyanine pigments are preferred in view of advantages that, when a heat-curable resin is used, they have a high heat resistance and maintain sensitivity relatively with ease even after heating.

The binder resin used to form the charge generation layer of the photosensitive layer having the multilayer structure may include polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. Examples are by no means limited to these. Any of these may be used alone or in the form of a mixture or copolymer of two or more types.

As a solvent used for a charge generation layer coating fluid, it may be selected taking account of the resin to be used and the solubility or dispersion stability of the charge-generating material. As an organic solvent, usable are alcohols, sulfoxides, ketones, ethers, esters, aliphatic halogenated hydrocarbons or aromatic compounds.

To form the charge generation layer, the above charge-generating material may be well dispersed in the binder resin, which is used in a 0.3- to 4-fold quantity, together with the solvent by means of a homogenizer, an ultrasonic dispersion machine, a ball mill, a sand mill, an attritor or a roll mill, and the resultant dispersion is coated, followed by drying. It may preferably be formed in a layer thickness of 5 μm or less, and particularly within the range of from 0.01 μm to 1 μm.

To the charge generation layer, a sensitizer, an antioxidant, an ultraviolet absorber and a plasticizer which may be of various types, and any known charge-generating material may also optionally be added.

The charge-transporting material used in the electrophotographic photosensitive member of the present invention may include various triarylamine compounds, various hydrazone compounds, various styryl compounds, various stilbene compounds, various pyrazoline compounds, various oxazole compounds, various thiazole compounds, and various triarylmethane compounds.

As the binder resin used to form the charge transport layer of the photosensitive layer having the multilayer structure, preferable are acrylic resins, styrene resins, polyester resins, polycarbonate resins, polyarylate resins, polysulfone resins, polyphenylene oxide resins, epoxy resins, polyurethane resins, alkyd resins and unsaturated resins. Polymethyl methacrylate, polystyrene, a styrene-acrylonitrile copolymer, polycarbonate resins and diallyl phthalate resins are more preferable.

The charge transport layer may commonly be formed by coating a solution prepared by dissolving the above charge-transporting material and binder resin in a solvent, followed by drying. The charge-transporting material and the binder resin may be mixed in a proportion of from about 2:1 to 1:2 in weight ratio. As the solvent, usable are ketones such as acetone and methyl ethyl ketone, esters such as methyl acetate and ethyl acetate, aromatic hydrocarbons such as toluene and xylene, and chlorinated hydrocarbons such as chlorobenzene, chloroform and carbon tetrachloride. When this coating solution is coated, coating methods as exemplified by dip coating, spray coating and spinner coating may be used. The drying may be carried out at a temperature ranging from 10° C. to 200° C., and preferably from 20° C. to 150° C., for a time of preferably from 5 minutes to 5 hours, and more preferably from 10 minutes to 2 hours, under air drying or drying at rest.

The charge transport layer is kept electrically connected with the above charge generation layer. It has the function to receive charge carriers injected from the charge generation layer in the presence of an electric field and at the same time transport these charge carriers to the interface between it and the protective layer.

This charge transport layer has a limit to the transporting of charge carriers, and hence can not be made to have a larger layer thickness than is necessary. Its layer thickness may preferably within the range of from 5 to 40 $\mu$m, and particularly preferably from 7 to 30 $\mu$m.

To the charge transport layer, an antioxidant, an ultraviolet absorber, a plasticizer and any known charge-transporting material may further optionally be added.

In the present invention, the protective layer described previously is formed on this charge transport layer by coating, followed by curing to complete the electrophotographic photosensitive member of the present invention.

Specific embodiments of an electrophotographic apparatus making use of the electrophotographic photosensitive member of the present invention are shown below.

Embodiment 1

Figure 2:
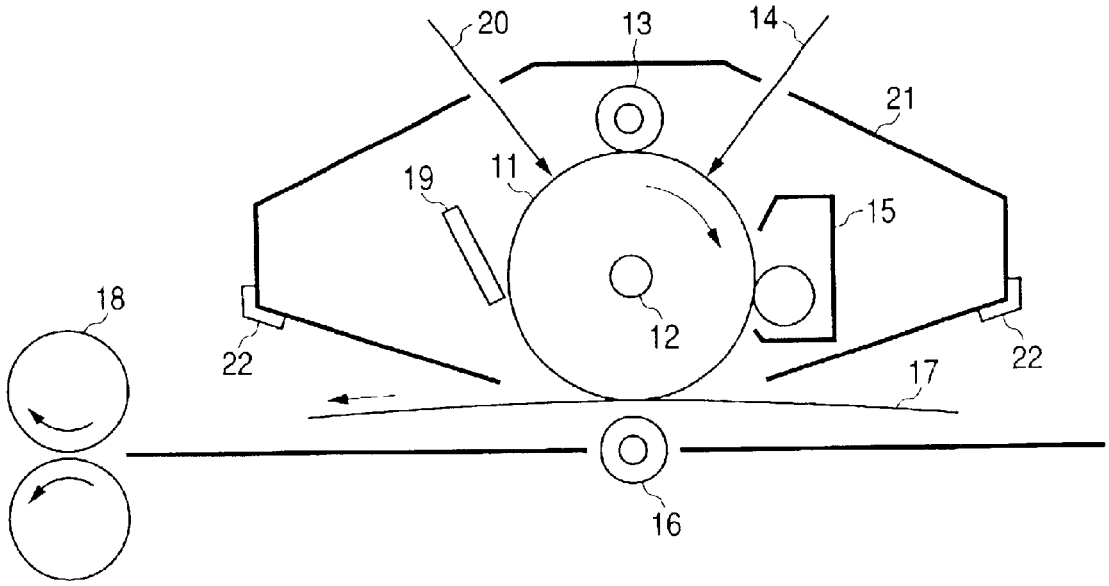
FIG. 2 illustrates an example of the construction of an electrophotographic apparatus provided with a process cartridge having an electrophotographic photosensitive member, according to Embodiment 1 of the present invention.

FIG. 2 schematically illustrates the construction of an electrophotographic apparatus provided with a process cartridge having the electrophotographic photosensitive member of the present invention.

In FIG. 2, reference numeral 11 denotes a drum-shaped electrophotographic photosensitive member of the present invention, which is rotatingly driven around an axis 12 in the direction of an arrow at a stated peripheral speed.

The electrophotographic photosensitive member 11 is, in the course of its rotation, uniformly electrostatically charged on its periphery to a positive or negative, given potential through a (primary) charging means 13. The electrophotographic photosensitive member thus charged is then exposed to exposure light 14 emitted from an exposure means (not shown) for slit exposure or laser beam scanning exposure and intensity-modulated correspondingly to time-sequential digital image signals of the intended image information. In this way, electrostatic latent images corresponding to the intended image information are successively formed on the periphery of the electrophotographic photosensitive member 11.

The electrostatic latent images thus formed are subsequently developed with toner by the operation of a developing means 15. The toner images thus formed and held on the surface of the electrophotographic photosensitive member 11 are then successively transferred by the operation of a transfer means 16, to a transfer material 17 fed from a paper feed section (not shown) to the part between the electrophotographic photosensitive member 11 and the transfer means 16 in the manner synchronized with the rotation of the electrophotographic photosensitive member 11.

The transfer material 17 on which the toner images have been transferred is separated from the surface of the electrophotographic photosensitive member, is led through an image fixing means 18, where the toner images are fixed, and is then printed out of the apparatus as an image-formed material (a print or copy).

The surface of the electrophotographic photosensitive member 11 from which images have been transferred is brought to removal of the toner remaining after the transfer, through a cleaning means 19. Thus, its surface is cleaned. Such transfer residual toner may also directly be collected through the developing means without providing any cleaning means (cleanerless). The electrophotographic photosensitive member is further subjected to charge elimination by pre-exposure light 20 emitted from a pre-exposure means (not shown), and then repeatedly used for the formation of images. Where the primary charging means 13 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 11, charging means 13, developing means 15 and cleaning means 19 so that the process cartridge is detachably mountable to the main body of an electrophotographic apparatus such as a copying machine or a laser beam printer. For example, at least one of the primary charging means 13, the developing means 15 and the cleaning means 19 may integrally be supported in a cartridge together with the electrophotographic photosensitive member 11 to form a process cartridge 21 that is detachably mountable to the main body of the apparatus through a guide means 22 such as rails provided in the main body of the apparatus.

In the case when the electrophotographic apparatus is a copying machine or a printer, the exposure light 14 is light reflected from, or transmitted through, an original, or light irradiated by the scanning of a laser beam, the driving of an LED array or the driving of a liquid-crystal shutter array according to signals obtained by reading an original through a sensor and converting the information into signals. Any other auxiliary process may also optionally be added.

Embodiment 2

Figure 3:
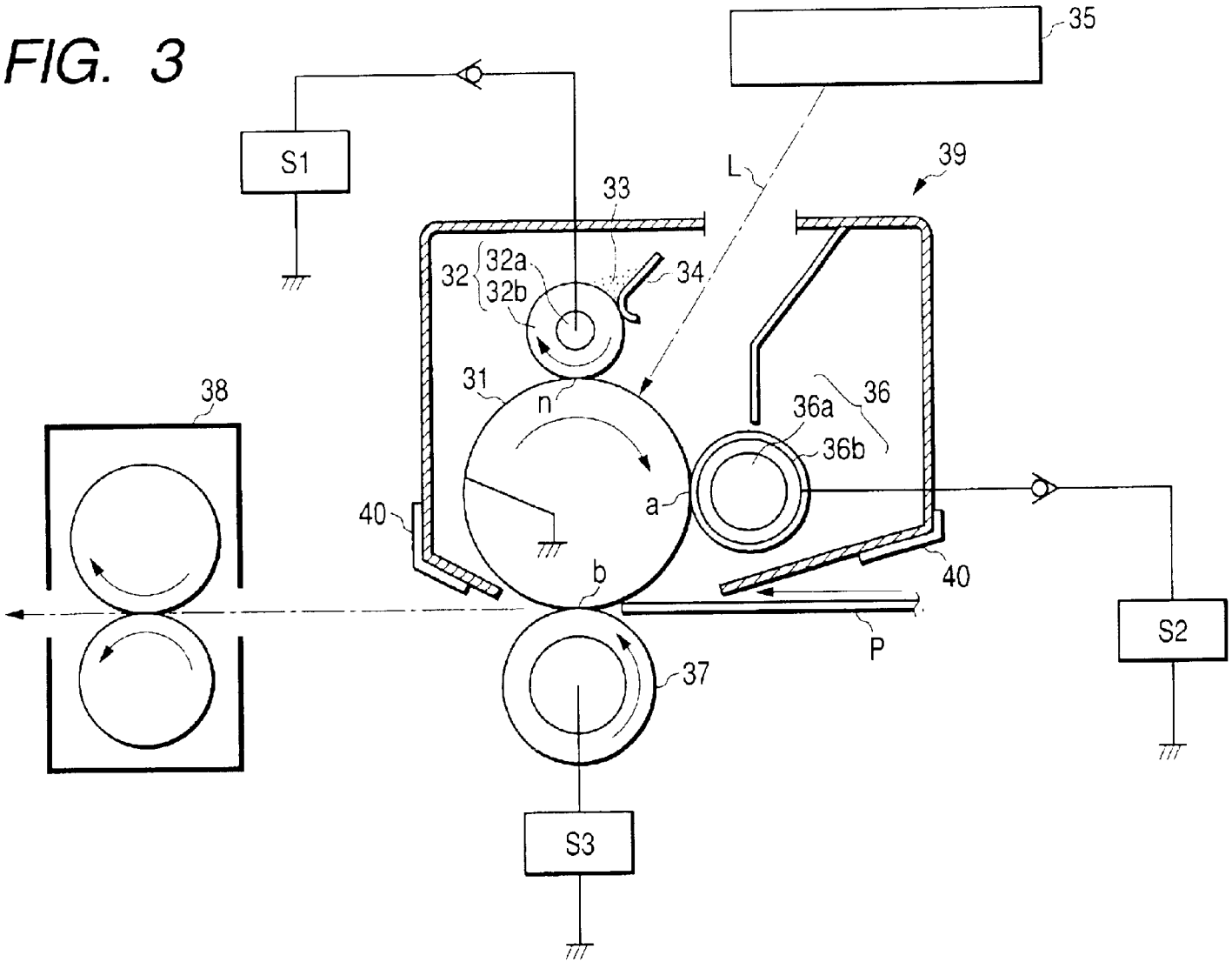
FIG. 3 illustrates an example of the construction of an electrophotographic apparatus provided with a process cartridge having a means for feeding charging particles to an electrophotographic photosensitive member, according to Embodiment 2 of the present invention.

FIG. 3 schematically illustrates the construction of an electrophotographic apparatus provided with a process cartridge having a means for feeding charging particles and having the electrophotographic photosensitive member of the present invention.

A drum-shaped electrophotographic photosensitive member 31 is rotatingly driven in the direction of an arrow at a constant peripheral speed.

A charging roller 32*a* charging means has is constituted of charging particles 33 (conductive particles for charging the electrophotographic photosensitive member electrostatically), and a medium-resistance layer (elastic layer) 32*b* and a mandrel 32*a* which constitute a charging-particle-holding member. The charging roller 32 is in contact with the electrophotographic photosensitive member 31 in a preset elastic deformation level to form a contact zone n.

The charging roller 32 in this embodiment is constituted of the mandrel 32*a* and formed thereon the medium-resistance layer 32*b* comprised of a rubber or a foam, and further held on its surface the charging particles 33.

The medium-resistance layer 32*b* is comprised of a resin (e.g., urethane), conductive particles (e.g., carbon black), a vulcanizing agent and a blowing agent or the like, and is formed into a roller on the mandrel 32*a*. Thereafter, its surface is polished.

The charging roller in this embodiment differs from the charging roller (charging roller for discharging) in Embodiment 1 especially in the following points.

(1) Surface structure and roughness characteristics so designed as to hold the charging particles on its surface in a high density.
(2) Resistance characteristics (volume resistivity, surface resistance) necessary for injection charging.

The charging roller for discharging has a flat surface, and has a surface average roughness Ra of submicrons or less and also a high roller hardness. In the charging which utilizes discharging, a phenomenon of discharge takes place at spaces of tens of micrometers ($\mu$m) which are at a little distance from the contact zone between the charging roller and the electrophotographic photosensitive member. Where the charging roller and electrophotographic photosensitive member surfaces have any unevenness, the phenomenon of discharge may come unstable because of electric field intensities which differ at some part, to cause charge non-uniformity. Hence, the charging roller for discharging requires a flat and highly hard surface.

Now, the reason why the charging roller for discharging can not perform injection charging is that, although the charging roller having such surface structure as stated above externally appears to be in close contact with the drum (electrophotographic photosensitive member), the former is little in contact with the latter in the sense of microscopic contact performance on a molecular level which is necessary for charge injection.

On the other hand, the charging roller 32 for injection charging is required to have a certain roughness because it is necessary to hold thereon the charging particles 33 in a high density. It may preferably have an average surface roughness Ra of from 1 $\mu$m to 500 $\mu$m. If it has an Ra of less than 1 $\mu$m, it may have an insufficient surface area for holding thereon the charging particles 33, and also, where any insulator (e.g., the toner) has adhered to the roller surface layer, at its surroundings the charging roller 32 can come into contact with the electrophotographic photosensitive member 31 with difficulty, to tend to lower its charging performance. If on the other hand it has an Ra of more than 500 $\mu$m, the unevenness of the charging roller surface tends to lower the in-plane charge uniformity of the electrophotographic photosensitive member.

The average surface roughness Ra is measured with a surface profile analyzer microscope VF-7500 or VF-7510, manufactured by Keyence Co. Using objective lenses of 1,250 magnifications to 2,500 magnifications, the roller surface profile and Ra can be measured in non-contact.

The charging roller for discharging comprises a mandrel on which a low-resistance base layer is formed and thereafter its surface is covered with a high-resistance layer. In the roller charging effected by discharging, applied voltage is so high that, if there are any pinholes (at which the support stands uncovered because of the damage of the film), the drop of voltage may extend up to their surroundings to cause faulty charging. Accordingly, the charging roller may preferably be made to have a surface resistivity of $10^{11}$ Ω□ or more.

On the other hand, in the injection charging system, it is unnecessary to make the surface layer have a high resistance in order to make it possible to perform charging at a low voltage, and the charging roller may be constituted of a single layer. In the injection charging, the charging roller may rather preferably have a surface resistivity of from $10^4$ to $10^{10}$ Ω□. If it has a surface resistivity of more than $10^{10}$ Ω□, the in-plane charge uniformity may lower, and any non-uniformity due to the rubbing friction of the charging roller may appear as lines in halftone images, and a lowering of image quality level tends to be seen. If on the other hand it has a surface resistivity of less than $10^{10}$ Ω□, any pinholes of the electrophotographic photosensitive member tend to cause the drop of voltage at their surroundings even in the injection charging.

The charging roller may further preferably have a volume resistivity ranging from $10^4$ to $10^7$ Ω·cm. If it has a volume resistivity of less than $10^4$ Ω·cm, the drop of voltage tends to occur because of a leakage of electric current through pinholes. If on the other hand it has a volume resistivity of more than $10^7$ Ω·cm, any electric current necessary for the charging may be ensured with difficulty to tend to cause a lowering of charging voltage.

The resistivities of the charging roller are measured in the following way.

To measure roller resistivities, an insulator drum of 30 mm in outer diameter is provided with electrodes in such a way that a load of 1 kg in total pressure is applied to the mandrel 32*a* of the charging roller 32. As the electrodes, a guard electrode is disposed around a main electrode to make measurement. The distance between the main electrode and the guard electrode is adjusted substantially to the thickness of the elastic layer 32*b* so that the main electrode may ensure a sufficient width in respect to the guard electrode. To make measurement, a voltage of +100 V is applied from a power source to the main electrode, and electric currents flowing to ammeters Av and As are measured, and the volume resistivity and the surface resistivity, respectively, are measured.

In the injection charging system, it is important for the charging roller 32 to function as a soft electrode. In the case of a magnetic brush, it is materialized to do so in virtue of the flexibility a magnetic-particle layer itself has. In this embodiment, it is achieved by controlling the elastic properties of the medium-resistance layer (elastic layer) 32*b*. This layer may have an Asker-C hardness of from 15 degrees to 50 degrees as a preferable range, and from 25 degrees to 40 degrees as a more preferable range. If this layer has a too high hardness, any necessary elastic deformation level can not be attained, and the contact zone n can not be ensured between the charging roller and the electrophotographic photosensitive member, resulting in a lowering of charging performance. Also, the contact performance on a molecular level of substance can not be attained, and hence any inclusion of foreign matter may obstruct the contact at its surroundings. If on the other hand this layer has a too low hardness, the roller may have unstable shape to provide a non-uniform pressure of contact with the charging object (electrophotographic photosensitive member) to cause charge non-uniformity. Otherwise, such a layer may cause faulty charging due to compression set of the roller as a result of its long-term leaving.

Materials for the charging roller 32 may include ethylene-propylene-diene-methylene rubber (EPDM), urethane rubber, nitrile-butadiene rubber (NBR) and silicone rubber, and rubber materials such as isoprene rubber (IR) in which a conductive substance such as carbon black or a metal oxide has been dispersed for the purpose of resistance control.

Without dispersing any conductive substance, it is also possible to make resistance control by using an ion-conductive material. Thereafter, if necessary, the surface roughness may be adjusted, or shaping may be made by polishing or the like. Also, a plurality of functionally separated layers may make up the elastic layer.

As a form of the roller, a porous-member structure is preferable. This is advantageous in view of manufacture in that the above surface roughness is achievable at the same time the roller is formed by molding. It is suitable for the porous member to have a cell diameter of from 1 μm to 500 μm. After the porous member has been formed by foam molding, its surface may be abraded to make the porous surface exposed, to produce a surface structure having the above roughness.

The charging roller 32 is provided in a stated elastic deformation level in respect to the electrophotographic photosensitive member 31 to form the contact zone n. At this contact zone n, the charging roller, which is rotatingly driven in the direction opposite (counter) to the rotational direction of the electrophotographic photosensitive member 31, can come into contact with the electrophotographic photosensitive member 31 in the state the former has a velocity difference in respect to the latter's surface movement. Also, at the time of image recording of a printer, a stated charging bias is applied to the charging roller 32 from a charging bias application power source S1. Thus, the periphery of the electrophotographic photosensitive member 31 is uniformly electrostatically charged to stated polarity and potential by the injection charging system.

The charging particles 33 are added to the toner and held in a developing assembly, and they are fed to the charging roller 32 via the electrophotographic photosensitive member 31 at the same time the toner participates in development. As a feeding means therefor, construction is employed in which a control blade 34 is brought into contact with the charging roller 32 and the charging particles 33 are held between the charging roller 32 and the control blade 34. Then, the charging particles 33 are coated in a constant quantity on the charging roller 32 as the electrophotographic photosensitive member 31 is rotated, and reach the contact zone n between the charging roller 32 and the electrophotographic photosensitive member 31.

The charging particles 33 may also preferably have a particle diameter of 10 μm or less in order to ensure high charging efficiency and charging uniformity. In the present invention, the particle diameter in a case in which the charging particles constitute agglomerates is defined as average particle diameter of the agglomerates, as such. To measure the particle diameter, at least 100 particles are picked up through observation on an electron microscope, where their volume particle size distribution is calculated on the basis of horizontal-direction maximum chordal length, and the particle diameter is determined on the basis of its 50% average particle diameter.

The charging particles 33 not only may be present in the state of primary particles, but also may be present in the state of agglomerated secondary particles without any problem at all. In whatever state of agglomeration, their form is not important as long as the agglomerates, as such, can function as the charging particles.

The charging particles 33 may preferably be white or closely transparent so that they do not especially obstruct latent-image exposure when used in the charging of the electrophotographic photosensitive member. They may further preferably be colorless or white when used in color image recording, taking account of the fact that the charging particles may partly inevitably be transferred to the transfer material P from the surface of the electrophotographic photosensitive member 31. Also, in order to prevent light scattering from being caused by the charging particles 33 at the time of imagewise exposure, they may preferably have a particle diameter which is not larger than the size of component image pixels, and more preferably not larger than the particle diameter of the toner. As the lower limit of the particle diameter, 10 nm is considered to be the limit as a size in which they are stably obtainable as particles.

Reference numeral 36 denotes a developing assembly. Electrostatic latent images formed on the surface of the electrophotographic photosensitive member 31 are developed as toner images by means of this developing assembly 36 at a developing zone a. In the developing assembly 36, a blended agent of a toner and charging particles added thereto is provided.

The electrophotographic apparatus (printer) in this embodiment carries out a toner recycle process. The transfer residual toner having remained on the surface of the electrophotographic photosensitive member 31 after transfer of toner images is not removed by a cleaning means (cleaner) used exclusively therefor, but is temporarily collected on the charging roller 32 which is counter-rotated as the electrophotographic photosensitive member 31 is rotated. Then, as it moves circularly on the periphery of the charging roller 32, the toner whose electric charges having been reversed are normalized is successively thrown out to the electrophotographic photosensitive member 31 and reaches the developing zone a, where it is collected at a developing means 36 including a magnet roller 36*a* and a developing sleeve 36*b* by cleaning-at-development and is reused there.

Reference numeral 35 denotes a laser beam scanner (exposure means) having a laser diode polygon mirror and so forth. This laser beam scanner 35 emits laser light intensity-modulated correspondingly to time-sequential digital image signals of the intended image information, and subjects the uniformly charged surface of the electrophotographic photosensitive member to scanning exposure L through the laser light. As a result of this scanning exposure L, electrostatic latent images corresponding to the intended image information are formed on the surface of the electrophotographic photosensitive member 31. The electrostatic latent images thus formed are developed by the developing means 36 to form toner images. To the developing means 36, a developing bias is applied from a power source S2.

Reference numeral 38 denotes a fixing means of, e.g., a heat fixing system. A transfer material P which has been fed to a transfer contact zone b between the electrophotographic photosensitive member 31 and a transfer roller 37 and to which the toner images have been transferred thereat under application of transfer bias from a power source S3 is separated from the surface of the electrophotographic photosensitive member 31. It is then guided into this fixing means 38, where the toner images are fixed, and then put out of the apparatus as an image-formed matter (a print or a copy).

Reference numeral 39 denotes a process cartridge which, in this embodiment, is constituted of the electrophotographic photosensitive member 31, the charging roller 32 and the developing assembly 36 which are integrally supported in the cartridge, and is detachably mountable to the main body of the apparatus through a guide means such as rails 40 provided in the main body of the apparatus.

The electrophotographic photosensitive member of the present invention may be not only applied in electrophotographic copying machines, but also widely applied in the fields where electrophotography is applied, e.g., laser beam printers, CRT printers, LED printers, FAX, liquid-crystal printers, and laser platemaking.

The present invention is described below in greater detail by giving Examples. The present invention may be carried out in great variety within the purport thereof, and is by no means limited to following Examples. In the following Examples and Comparative Examples, "part(s)" refers to "part(s) by weight".

EXAMPLE 1

On an aluminum cylinders of 29 mm in outer diameter, a solution prepared by dissolving 10 parts of a copolymer polyamide resin (trade name: AMILAN CM8000; available from Toray Industries, Inc.) in a mixed solvent of 60 parts of methanol and 40 parts of butanol was coated by dipping, followed by drying with heating at 90° C. for 10 minutes to form a conductive layer with a layer thickness of 0.5 μm.

Next, a liquid mixture comprised of 4 parts of an oxytitanium phthalocyanine pigment represented by the following formula:

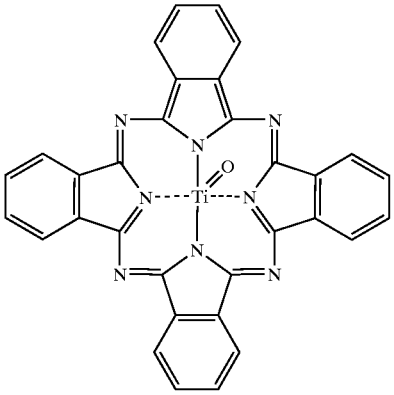

and having strong peaks at Bragg's angles (2θ±0.2°) of 9.0° and 27.1° in the CuKα characteristic X-ray diffraction, 2 parts of polyvinyl butyral resin (trade name: S-LEC BX-1; available from Sekisui Chemical Co., Ltd.) and 70 parts of cyclohexanone was dispersed for 10 hours by means of a sand mill, followed by addition of 100 parts of ethyl acetate to prepare a charge generation layer coating fluid. This coating fluid was coated on the above conductive layer by dipping, followed by drying with heating at 90° C. for 10 minutes to form a charge generation layer with a layer thickness of 0.17 μm.

Next, a solution prepared by dissolving 7 parts of a triarylamine compound represented by the following formula:

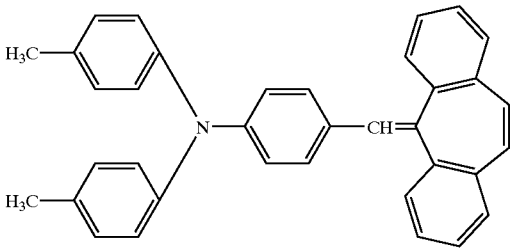

and 10 parts of a polycarbonate (trade name: IUPILON Z-200; available from Mitsubishi Gas Chemical Company, Inc.) in 70 parts of chlorobenzene was coated on the above charge generation layer by dipping, followed by drying with heating at 110° C. for 1 hour to form a charge transport layer with a layer thickness of 20 μm.

Next, for a protective layer, 50 parts of antimony-doped ultrafine tin oxide particles surface-treated with a compound (amount of treatment: 7%) having structure represented by the following formula:

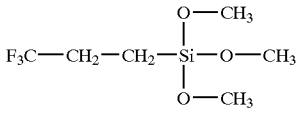

and 150 parts of ethanol were dispersed by means of a sand mill over a period of 66 hours (average particle diameter: 0.03 μm). Thereafter, in the resultant dispersion, 30 parts of resol type phenolic resin (trade name: PL-4804; available from Gun-ei Chemical Industry Co., Ltd.; synthesized using an amine type catalyst, amine compound) was dissolved as a resin component to prepare a coating fluid (protective-layer coating fluid). Using this coating fluid, a film was formed on the above charge transport layer by dip coating, followed by hot-air drying at a temperature of 145° C. for 1 hour. Thus, an electrophotographic photosensitive member having a protective layer was obtained. The protective-layer coating fluid was in a good state of dispersion, and the protective layer produced was an unevenness-free, uniform film.

The We % of the electrophotographic photosensitive member thus obtained was measured to find that it was 45.3%. Also, the $|\alpha_1-\alpha_2|$ was found to be $2.7\times10^{-6}$° C.$^{-1}$.

Evaluation was made using evaluation apparatus described below.

Evaluation Apparatus 1:

The electrophotographic photosensitive member produced was fitted to an electrophotographic apparatus obtained by remodeling a printer (LASER JET 4000) manufactured by Hewllet-Pachard Co. (so remodeled as to have the construction of the apparatus of Embodiment 2) to make evaluation.

In respect of the charging part of the electrophotographic photosensitive member, the charging roller was produced by forming a rubber medium-resistance layer on a mandrel. Here, the medium-resistance layer was comprised of urethane resin, conductive particles (carbon black), a vulcanizing agent and a blowing agent, and was formed into a roller on the mandrel. Thereafter, its surface was polished to produce an elastic conductive roller of 12 mm in diameter and 250 mm in length. The electrical resistance of this roller was measured to find that it was 100 kΩ. It was measured applying a voltage of 100 V to the mandrel of the charging roller and the support of the electrophotographic photosensitive member in the state the charging roller was kept in pressure contact with the electrophotographic photosensitive member in such a way that a load of 1 kg in total pressure was applied to the former's mandrel.

In this evaluation apparatus, conductive zinc oxide particles with a volume resistivity of $10^6$ Ω·cm and an average particle diameter of 3 μm were used as the charging particles for performing injection charging.

A charging-particle coating means for coating the charging particles on the charging roller was also provided in order to feed the charging particles uniformly to the contact zone between the charging roller and the electrophotographic photosensitive member. As a feeding means therefor, construction is employed in which a control blade is brought into contact with the charging roller and the charging particles are held between the charging roller and the control blade. Then, the charging particles are coated in a constant quantity on the charging roller as the electrophotographic photosensitive member 31 is rotated.

In this evaluation apparatus, the charging roller is rotated in the state it has a velocity difference in respect to the electrophotographic photosensitive member. The electrophotographic photosensitive member of the present invention is a small-diameter drum-shaped member having a diameter of less than 30 mm, and is rotated at a constant speed of 110 mm/sec. in peripheral speed. In this evaluation apparatus, it was remodeled in conformity with the diameter of the cylindrical support of the electrophotographic photosensitive member in this Example.

The charging particles are first coated on the charging roller surface by means of the control blade. Thereafter, they reach the contact zone between the charging roller and the electrophotographic photosensitive member. Here, the charging roller was so driven at 150 rpm that the roller surface moved at a speed equal to the surface movement of the electrophotographic photosensitive member and in the direction opposite to each other, and, as applied voltage, a DC voltage of −620 V was applied to the roller mandrel. Thus, the electrophotographic photosensitive member surface is electrostatically charged to a potential equal to the applied voltage. In the charging in this evaluation apparatus, the charging particles present at the contact zone between the charging roller and the electrophotographic photosensitive member rub the electrophotographic photosensitive member closely to perform the injection charging.

Evaluation Apparatus 2:

The printer (LASER JET 4000) manufactured by Hewllet-Pachard Co. was remodeled in conformity with the diameter of the cylindrical support of the electrophotographic photosensitive member in this Example. The system of electrophotographic processing such as charging, development, transfer and cleaning was kept as it was. That is, it has the construction of the apparatus of Embodiment 1.

The electrophotographic photosensitive member obtained was fitted to the evaluation apparatus 1, and images were continuously reproduced on 10,000 sheets in an environment of high temperature and high humidity (30° C./80% RH). The images reproduced were all on a high quality level. After the image reproduction, the surface of the electrophotographic photosensitive member was observed on a microscope to find that any scratches or the like were not seen at all.

The electrophotographic photosensitive member obtained was also fitted to the evaluation apparatus 2, and images were continuously reproduced on 10,000 sheets, where any chattering did not occur.

The results are shown in Table 1.

EXAMPLE 2

An electrophotographic photosensitive member was produced in entirely the same manner as in Example 1 except that the protective layer of the electrophotographic photosensitive member was formed in the following way and also the cylindrical support was changed to one having an outer diameter of 24 mm.

As a protective-layer coating fluid, 82 parts of ethanol, 21 parts of a charge-transporting material having structure represented by the following formula:

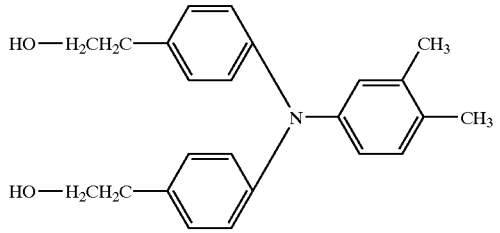

and 67 parts of a resin component resol type phenolic resin (trade name: PR-53123; non-volatile component: 45%; available from Sumitomo Durez Co., Ltd.; synthesized using a metal type catalyst) as a non-volatile component were dissolved, and the solution obtained was stirred for 4 hours to prepare a protective-layer coating fluid. This was coated on the charge transport layer by dipping, followed by hot-air drying at a temperature of 145° C. for 1 hour. Thus, an electrophotographic photosensitive member having a protective layer was obtained.

The We % of the electrophotographic photosensitive member thus obtained was measured to find that it was 50.7%. Also, the $|\alpha_1-\alpha_2|$ was found to be $5.6\times10^{-5}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). In this electrophotographic photosensitive member, it was partly unable to be sufficiently charged to cause fog, but, in an attempt of continuous reproduction, no imperfections were observed on the images reproduced.

The electrophotographic photosensitive member obtained was also fitted to the evaluation apparatus 2, and images were continuously reproduced on 10,000 sheets, where any chattering did not occur.

The results are shown in Table 1.

EXAMPLE 3

An electrophotographic photosensitive member was produced in entirely the same manner as in Example 1 except that the phenolic resin used therein, synthesized using an amine type catalyst (amine compound) was changed for a phenolic resin synthesized using a metal type catalyst.

The We % of the electrophotographic photosensitive member thus obtained was measured to find that it was 52.7%. Also, the difference between a coefficient of thermal expansion measured from the top of the protective layer and a coefficient of thermal expansion measured after the protective layer has been removed, $|\alpha_1-\alpha_2|$, was found to be $7.2\times10^{-6}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). The images reproduced were all on a high quality level. After the image reproduction, the surface of the electrophotographic photosensitive member was observed on a microscope to find that any scratches or the like were not seen at all.

The electrophotographic photosensitive member obtained was also fitted to the evaluation apparatus 2, and images were continuously reproduced on 10,000 sheets, where any chattering did not occur.

The results are shown in Table 1.

EXAMPLE 4

An electrophotographic photosensitive member was produced in entirely the same manner as in Example 1 except that the resol type phenolic resin used therein for the protective layer was changed for BKS-316 (trade name; available from Showa Highpolymer Co., Ltd.; synthesized using an amine type catalyst (amine compound) other than ammonia).

The We % of the electrophotographic photosensitive member thus obtained was measured to find that it was 30.2%. Also, the difference between a coefficient of thermal expansion measured from the top of the protective layer and a coefficient of thermal expansion measured after the protective layer has been removed, $|\alpha_1-\alpha_2|$, was found to be $8.3\times10^{-7}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). The images reproduced were all on a high quality level. However, in the microscopic observation of the surface of the electrophotographic photosensitive member after the image reproduction, some scratches not having appeared on images were seen.

The electrophotographic photosensitive member obtained was also fitted to the evaluation apparatus 2, and images were continuously reproduced on 10,000 sheets, where any chattering did not occur.

The results are shown in Table 1.

COMPARATIVE EXAMPLE 1

An electrophotographic photosensitive member was produced in entirely the same manner as in Example 1 up to the formation of the charge transport layer and except that the phenolic resin used in the protective layer was changed for 20 parts of an acrylic monomer having structure represented by the following formula:

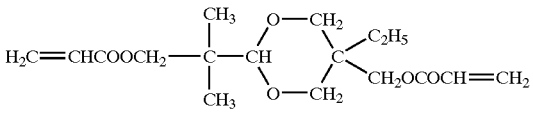

and 3 parts of 2-methylthioxantone was further added to prepare a coating fluid.

The We % of the electrophotographic photosensitive member thus obtained was measured to find that it was 28.9%. Also, the difference between a coefficient of thermal expansion measured from the top of the protective layer and a coefficient of thermal expansion measured after the protective layer has been removed, $|\alpha_1-\alpha_2|$, was found to be $5.2\times10^{-6}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). Image defects appeared on the images reproduced. The surface of the electrophotographic photosensitive member after the image reproduction was observed on a microscope to find that deep scratches were seen at the places corresponding to the places where the image defects appeared.

The electrophotographic photosensitive member obtained was also fitted to the evaluation apparatus 2, and images were continuously reproduced on 10,000 sheets, where any chattering did not occur, but, like the case of the evaluation apparatus 1, image defects appeared on the images reproduced. The surface of the electrophotographic photosensitive member after the image reproduction was observed on a microscope to find that deep scratches were seen at the places corresponding to the places where the image defects appeared.

The results are shown in Table 1.

EXAMPLE 5

An electrophotographic photosensitive member was produced in entirely the same manner as in Example 1 except that the phenolic resin used therein was changed for melamine resin (trade name: CYMEL 701 available from Mitsui Cytec Ltd.).

The We % of the electrophotographic photosensitive member thus obtained was measured to find that it was 59.6%. Also, the difference between a coefficient of thermal expansion measured from the top of the protective layer and a coefficient of thermal expansion measured after the protective layer has been removed, $|\alpha_1-\alpha_2$, was found to be $6.4\times10^{-7}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). The images reproduced were all on a high quality level. However, in the microscopic observation of the surface of the electrophotographic photosensitive member after the image reproduction, some filming was seen.

The electrophotographic photosensitive member obtained was also fitted to the evaluation apparatus 2, and images were continuously reproduced on 10,000 sheets, where any chattering did not occur although some image defects were seen.

The results are shown in Table 1.

COMPARATIVE EXAMPLE 2

An electrophotographic photosensitive member was produced in entirely the same manner as in Example 4 except that 20 parts of the melamine resin was used in an amount changed to 50 parts.

The We % of the electrophotographic photosensitive member thus obtained was measured to find that it was 60.8%. Also, the difference between a coefficient of thermal expansion measured from the top of the protective layer and a coefficient of thermal expansion measured after the protective layer has been removed, $|\alpha_1-\alpha_2|$, was found to be $5.7\times10^{-6}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). Image defects appeared on the images reproduced. The surface of the electrophotographic photosensitive member after the image reproduction was observed on a microscope to find that filming was seen to have occurred. This was judged to have caused the image defects.

The electrophotographic photosensitive member obtained was also fitted to the evaluation apparatus 2, and images were continuously reproduced on 10,000 sheets, where any chattering did not occur, but, like the case of the evaluation apparatus 1, image defects appeared on the images reproduced. The surface of the electrophotographic photosensitive member after the image reproduction was observed on a microscope to find that filming was seen to have occurred.

The results are shown in Table 1.

EXAMPLE 6

An electrophotographic photosensitive member was produced in entirely the same manner as in Example 1 except that the phenolic resin used therein was changed for 30 parts of an epoxy resin obtained by mixing EPIKOTE #815 and EPOMATE B002 (trade names; available from Yuka Shell Epoxy Kabushikikaisha) in a weight ratio of 2:1.

The We % of the electrophotographic photosensitive member thus obtained was measured to find that it was 46.7%. Also, the difference between a coefficient of thermal expansion measured from the top of the protective layer and a coefficient of thermal expansion measured after the protective layer has been removed, $|\alpha_1-\alpha_2|$, was found to be $5.2\times10^{-7}$° C.$^{-1}$.

The electrophotographic photosensitive member obtained was fitted to the evaluation apparatus 1, and images were continuously reproduced on 10,000 sheets in an environment of high temperature and high humidity (30° C./80% RH) The images reproduced were on a high quality level. After the image reproduction, the surface of the electrophotographic photosensitive member was observed on a microscope to find that neither scratches nor filming was not seen at all.

The electrophotographic photosensitive member obtained was also fitted to the evaluation apparatus 2, and images were continuously reproduced on 10,000 sheets, where chattering a little occurred, but was not on a level coming into question and was judged to be of no problem in practical use.

The results are shown in Table 1.

COMPARATIVE EXAMPLE 3

An electrophotographic photosensitive member was produced in entirely the same manner as in Example 1 except that the phenolic resin used therein was changed for 90 parts of an epoxy resin obtained by mixing EPIKOTE #815 and EPOMATE B002 (trade names; available from Yuka Shell Epoxy Kabushikikaisha) in a weight ratio of 2:1.

The We % of the electrophotographic photosensitive member thus obtained was measured to find that it was 52.8%. Also, the difference between a coefficient of thermal expansion measured from the top of the protective layer and a coefficient of thermal expansion measured after the protective layer has been removed, $|\alpha_1-\alpha_2|$, was found to be $4.9\times10^{-7}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). The images reproduced were on a high quality level. After the image reproduction, the surface of the electrophotographic photosensitive member was observed on a microscope to find that neither scratches nor filming was not seen at all.

The electrophotographic photosensitive member obtained was also fitted to the evaluation apparatus 2, and images were continuously reproduced on 10,000 sheets, where images on a high quality level was likewise reproducible, but, chattering occurred every time the electrophotographic photosensitive member was rotated.

The results are shown in Table 1.

EXAMPLE 7

An electrophotographic photosensitive member was produced in entirely the same manner as in Example 2 except that the charge-transporting material used therein in the protective layer was changed for a compound having structure represented by the following formula.

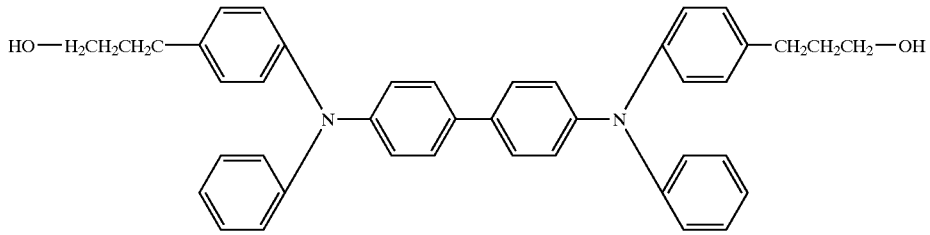

The We % of the electrophotographic photosensitive member thus obtained was measured to find that it was 49.2%. Also, the difference between a coefficient of thermal expansion measured from the top of the protective layer and a coefficient of thermal expansion measured after the protective layer has been removed, $|\alpha_1-\alpha_2|$, was found to be $9.7\times10^{-5}$° C.$^{-1}$.

The electrophotographic photosensitive member obtained was fitted to the evaluation apparatus 1, and images were continuously reproduced on 10,000 sheets in an environment of high temperature and high humidity (30° C./80% RH). The images reproduced were on a high quality level. After the image reproduction, the surface of the electrophotographic photosensitive member was observed on a microscope to find that the surface protective layer was about to come off at its end portions which were not image areas.

The electrophotographic photosensitive member obtained was also fitted to the evaluation apparatus 2, and images were continuously reproduced on 10,000 sheets, where images on a high quality level was likewise reproducible and any noise was also not made.

The results are shown in Table 1.

COMPARATIVE EXAMPLE 4

An electrophotographic photosensitive member was produced in entirely the same manner as in Example 6 except that the charge-transporting material used therein was changed for a compound having structure represented by the following formula.

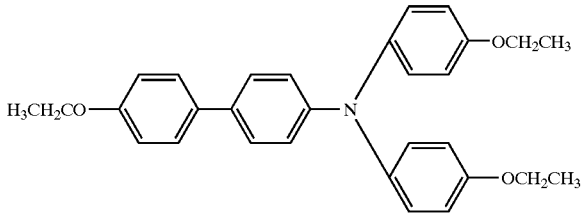

The We % of the electrophotographic photosensitive member thus obtained was measured to find that it was 37.2%. Also, the difference between a coefficient of thermal expansion measured from the top of the protective layer and a coefficient of thermal expansion measured after the protective layer has been removed, $|\alpha_1-\alpha_2|$, was found to be $1.2\times10^{-4\circ}$ C.$^{-1}$.

The electrophotographic photosensitive member obtained was fitted to the evaluation apparatus 1, and images were continuously reproduced on 10,000 sheets in an environment of high temperature and high humidity (30° C./80% RH) The images reproduced had image defects. After the image reproduction, the surface of the electrophotographic photosensitive member was observed on a microscope to find that the protective layer stood come off and many scratches were seen on the surface having uncovered.

The electrophotographic photosensitive member obtained was also fitted to the evaluation apparatus 2, and images were continuously reproduced on 10,000 sheets, where images on a high quality level was reproducible and any noise such as "chattering" was also not made.

The results are shown in Table 1.

EXAMPLE 8

An electrophotographic photosensitive member was produced and evaluated in the same manner as in Example 1 except that the protective layer of the electrophotographic photosensitive member formed therein was formed in the following way.

For the protective layer, 30 parts of antimony-doped ultrafine tin oxide particles surface-treated with a compound (amount of treatment: 7%) having structure represented by the following formula:

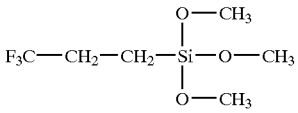

20 parts of antimony-doped fine tin oxide particles surface-treated with methylhydrogen silicone oil (trade name: KF99; available from Shin-Etsu Silicone Co., Ltd.) (amount of treatment: 20%) and 150 parts of ethanol were dispersed by means of a sand mill over a period of 66 hours (average particle diameter: 0.03 μm), and 20 parts of fine polytetrafluoroethylene particles (average particle diameter: 0.18 μm) were further added, followed by further dispersion for 2 hours.

Thereafter, in the resultant dispersion, 30 parts of resol type phenolic resin (trade name: PL-4852; available from Gun-ei Chemical Industry Co., Ltd.; synthesized using an amine type catalyst, amine compound) was dissolved as a resin component to prepare a coating fluid (protective-layer coating fluid). Using this coating fluid, a film was formed on the charge transport layer by dip coating, followed by hot-air drying at a temperature of 145° C. for 1 hour. Thus, an electrophotographic photosensitive member having a protective layer with a layer thickness of 2 μm was obtained. Here, the protective-layer coating fluid was in a good state of dispersion, and the protective layer produced was an unevenness-free, uniform film.

The We % and $|\alpha_1-\alpha_2|$ of the electrophotographic photosensitive member thus obtained were measured.

The electrophotographic photosensitive member obtained was also fitted to the evaluation apparatus 1, and images were continuously reproduced on 10,000 sheets in an environment of high temperature and high humidity (30° C./80% RH). The images reproduced were all on a high quality level. After the image reproduction, the surface of the electrophotographic photosensitive member was observed on a microscope to find that any scratches or the like were not seen at all. Further, compared with Example 1, color reproducibility of 16 gradation was found to be especially superior.

The electrophotographic photosensitive member obtained was also fitted to the evaluation apparatus 2, and images were continuously reproduced on 10,000 sheets, where any chattering did not occur.

The results are shown in Table 1.

EXAMPLES 9 TO 14

Electrophotographic photosensitive members were produced in the same manner as in Example 1 except that the protective layers of the electrophotographic photosensitive members were formed in the following way and also the cylindrical supports were changed to those having an outer diameter of 24 mm.

As protective-layer coating fluids, 82 parts of ethanol, 21 parts each of Exemplary Compounds (12), (25), (31), (44), (49) and (56) in the order of Examples 9 to 14, and 30 parts of a resin component resol type phenolic resin (trade name: PL-4852; available from Gun-ei Chemical Industry Co., Ltd.; synthesized using an amine type catalyst, amine compound) as a non-volatile component were dissolved, and the solution obtained was stirred for 4 hours. Thereafter, fine polytetrafluoroethylene particles (average particle diameter: 0.18 μm) were added thereto, followed by dispersion for 2 hours to prepare protective-layer coating fluids. Using these coating fluids, films were each formed on the charge transport layer by dip coating, followed by hot-air drying at a temperature of 145° C. for 1 hour. Thus, electrophotographic photosensitive members having protective layers with a layer thickness of 2 μm were obtained.

The We % and $|\alpha_1-\alpha_2|$ of the electrophotographic photosensitive members thus obtained were measured.

The electrophotographic photosensitive member obtained was also fitted to the evaluation apparatus 1, and images were continuously reproduced on 10,000 sheets in an environment of high temperature and high humidity (30° C./80% RH). The images reproduced were all images slightly fogged because of charging not well performed partly, but no imperfections were observed on the images even after the continuous image reproduction. After the image reproduction, the surface of the electrophotographic photosensitive member was further observed on a microscope to find that any scratches or the like were not seen at all.

The electrophotographic photosensitive member obtained was also fitted to the evaluation apparatus 2, and images were continuously reproduced on 10,000 sheets, where any chattering did not occur. Further, even compared with Example 2, fine-line reproducibility was found to be very superior.

The results are shown in Table 1.

TABLE 1

| | We % | $\alpha_1-\alpha_2$ | Evaluation after running Evaluation apparatus 1 | 2 |
|---|---|---|---|---|
| Example: | | | | |
| 1 | 45.3 | $2.7 \times 10^{-6}$ | Good. | Good. |
| 2 | 50.7 | $5.6 \times 10^{-5}$ | Slight fogging but no scratch. | Good. |
| 3 | 52.7 | $7.2 \times 10^{-6}$ | Good. | Good. |
| 4 | 30.2 | $8.3 \times 10^{-6}$ | Slight scratches but no problem on images. | Good. |
| 5 | 59.6 | $6.4 \times 10^{-6}$ | Slight filming but no problem on images. | Slight filming but no problem on images. |
| 6 | 46.7 | $5.2 \times 10^{-7}$ | Good. | Slight chattering but no problem in practical use. |
| 7 | 49.2 | $9.7 \times 10^{-5}$ | Slight come-off at ends but no problem in practical use. | Good. |
| 8 | 45.2 | $3.5 \times 10^{-6}$ | Especially good. | Good. |
| 9 | 37.9 | $5.2 \times 10^{-5}$ | Slight fogging but no scratch. | Well chattering-free & especially good images. |
| 10 | 49.8 | $6.6 \times 10^{-6}$ | Slight fogging but no scratch. | Well chattering-free & especially good images. |
| 11 | 53.3 | $9.4 \times 10^{-6}$ | Slight fogging but no scratch. | Well chattering-free & especially good images. |
| 12 | 51.1 | $7.5 \times 10^{-6}$ | Slight fogging but no scratch. | Well chattering-free & especially good images. |
| 13 | 42.2 | $4.1 \times 10^{-6}$ | Slight fogging but no scratch. | Well chattering-free & especially good images. |
| 14 | 46.1 | $5.4 \times 10^{-6}$ | Slight fogging but no scratch. | Well chattering-free & especially good images. |
| Comparative Example: | | | | |
| 1 | 28.9 | $5.2 \times 10^{-6}$ | Deep scratches. | Deep scratches. |
| 2 | 60.8 | $5.7 \times 10^{-6}$ | Filming. | Filming. |
| 3 | 52.8 | $4.9 \times 10^{-7}$ | Good. | Chattering. |
| 4 | 37.2 | $1.2 \times 10^{-4}$ | Come-off & scratches. | Good. |

REFERENCE EXAMPLES 1 TO 4

Electrophotographic photosensitive members were produced in the same manner as in Comparative Examples 1 to 4, respectively, except that the respective layers were formed on supports of 30 mm in outer diameter. Evaluation was made in the same way, where any problems such as come-off, scratches, chattering and melt adhesion did not occur which might remarkably occur in electrophotographic photosensitive members made small in diameter.

As described above, the present invention makes it possible to provide an electrophotographic photosensitive member which does not cause any come-off of, or toner's melt adhesion to, the protective layer even where the photosensitive layer and the protective layer are formed on a small-diameter cylindrical support, does not cause any noise such as chattering, and has a protective layer having superior scratch resistance and wear resistance; and a process cartridge and an electrophotographic apparatus which have such an electrophotographic photosensitive member.

What is claimed is:

1. An electrophotographic photosensitive member comprising a cylindrical conductive support, and provided thereon a photosensitive layer and a protective layer in this order, which cylindrical conductive support has an outer diameter of less than 30 mm, wherein;

the difference between a coefficient of thermal expansion $\alpha_1$ measured from the top of the protective layer and a coefficient of thermal expansion $\alpha_2$ measured after the protective layer has been removed, $|\alpha_1-\alpha_2|$, is more than $5.0\times10^{-7}$° C.$^{-1}$ to less than $1.0\times10^{-4}$° C.$^{-1}$; and the modulus of elastic deformation We % measured from the top of the protective layer is more than 30% to less than 60%.

2. The electrophotographic photosensitive member according to claim 1, wherein said protective layer contains a binder resin and at least one of conductive particles and a charge-transporting material.

3. The electrophotographic photosensitive member according to claim 2, wherein said binder resin is a curable resin.

4. The electrophotographic photosensitive member according to claim 3, wherein said curable resin is selected from the group consisting of a phenolic resin, an epoxy resin and a siloxane resin.

5. The electrophotographic photosensitive member according to claim 4, wherein said curable resin is a phenolic resin, and the phenolic resin is a resol type phenolic resin.

6. The electrophotographic photosensitive member according to claim 5, wherein said resol type phenolic resin is a resin synthesized in the presence of an alkali catalyst selected from the group consisting of alkali metal, an alkaline earth metal and an amine compound.

7. The electrophotographic photosensitive member according to claim 6, wherein said resol type phenolic resin is a resin synthesized in the presence of an amine compound.

8. The electrophotographic photosensitive member according to claim 4, wherein said curable resin is a phenolic resin, and the phenolic resin is a heat-curable phenolic resin.

9. The electrophotographic photosensitive member according to claim 1, wherein said protective layer contains at least conductive particles, and the conductive particles are metal particles or metal oxide particles.

10. The electrophotographic photosensitive member according to claim 1, wherein said protective layer contains at least one of a fluorine-atom-containing compound and a siloxane compound.

11. The electrophotographic photosensitive member according to claim 10, wherein said protective layer contains at least a fluorine-atom-containing compound, and the fluorine-atom-containing compound is a compound selected from the group consisting of a fluorine-containing silane coupling agent, a fluorine-modified silicone oil and a fluorine type surface-active agent.

12. The electrophotographic photosensitive member according to claim 10, wherein said protective layer contains at least a siloxane compound, and the siloxane compound is a siloxane compound having structure represented by the following Formula (1):

(1)

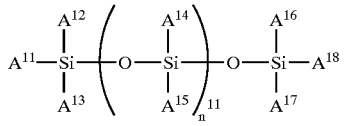

wherein $A^{11}$ to $A^{18}$ are each independently a hydrogen atom or a methyl group, provided that the proportion of the total number b of the hydrogen atoms in the total number a of A's, b/a, ranges from 0.001 or more to 0.5 or less; and $n^{11}$ is an integer of 0 or more.

13. The electrophotographic photosensitive member according to claim 1, wherein said protective layer contains lubricating particles.

14. The electrophotographic photosensitive member according to claim 13, wherein said lubricating particles are particles selected from the group consisting of fluorine-atom-containing resin particles, silicone resin particles, silica particles and alumina particles.

15. The electrophotographic photosensitive member according to claim 1, wherein said protective layer contains at least a charge-transporting material, and the charge-transporting material has a hydroxyl group in the molecule.

16. The electrophotographic photosensitive member according to claim 15, wherein said charge-transporting material has at least one of a hydroxyalkyl group and a hydroxyalkoxyl group in the molecule.

17. The electrophotographic photosensitive member according to claim 16, wherein said charge-transporting material having at least one of a hydroxyalkyl group and a hydroxyalkoxyl group in the molecule has structure represented by any one of the following Formulas (2) to (4):

(2)

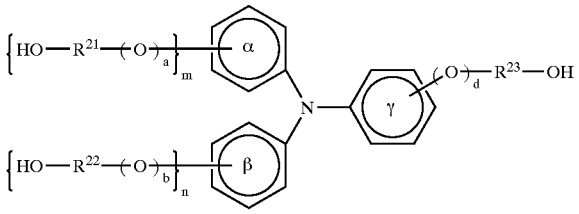

wherein $R^{21}$, $R^{22}$ and $R^{23}$ each independently represent a divalent hydrocarbon group having 1 to 8 carbon atoms and which may be branched; the benzene rings α, β and γ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; and letter symbols a, b, d, m and n each independently represent 0 or 1;

(3)

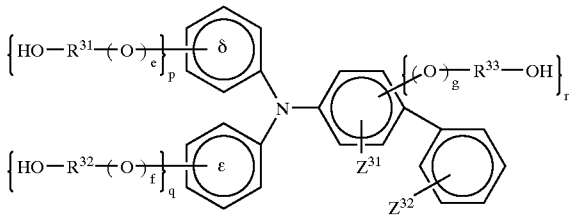

wherein $R^{31}$, $R^{32}$ and $R^{33}$ each independently represent a divalent hydrocarbon group having 1 to 8 carbon atoms and which may be branched; the benzene rings δ and ε may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; letter symbols e, f and g each independently represent 0 or 1; letter symbols p, q and r each independently represent 0 or 1, provided that a case in which all of them are simultaneously 0 is excluded; and $Z^{31}$ and $Z^{32}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring; and (4)

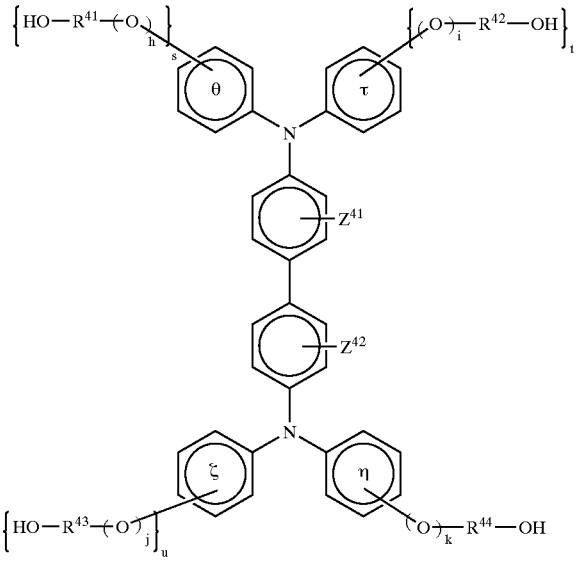

wherein $R^{41}$, $R^{42}$, R43 and $R^{44}$ each independently represent a divalent hydrocarbon group having 1 to 8 carbon atoms and which may be branched; the benzene rings ζ, η, θ and ι may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; letter symbols h, i, j, k, s, t and u each independently represent 0 or 1; and $Z^{41}$ and $Z^{42}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

18. The electrophotographic photosensitive member according to claim 1, wherein said protective layer contains at least a charge-transporting material, and the charge-transporting material has a hydroxyphenyl group in the molecule.

19. The electrophotographic photosensitive member according to claim 18, wherein said charge-transporting material having a hydroxyphenyl group in the molecule has structure represented by any one of the following Formulas (5) to (7):

(5)

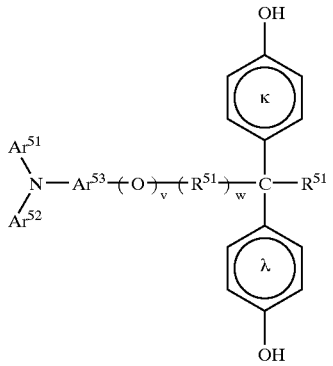

wherein $R^{51}$ represents a divalent hydrocarbon group having 1 to 8 carbon atoms and which may be branched; $R^{52}$ represents a hydrogen atom, a substituted or unsubstituted alkyl group, a substituted or unsubstituted aralkyl group or a substituted or unsubstituted phenyl group; $Ar^{51}$ and $Ar^{52}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group; $Ar^{53}$ represents a substituted or unsubstituted divalent aromatic hydrocarbon ring group or a substituted or unsubstituted divalent aromatic heterocyclic group; letter symbols v and w each independently represent 0 or 1, provided that w is 0 when v is 0; and the benzene rings κ and λ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group;

(6)

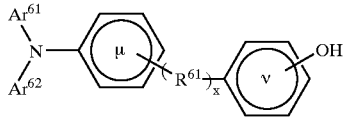

wherein $R^{61}$ represents a divalent hydrocarbon group having 1 to 8 carbon atoms and which may be branched; $Ar^{61}$ and $Ar^{62}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group; letter symbol x represents 0 or 1; and the benzene rings μ and ν may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings μ and ν may combine via a substituent to form a ring;

(7)

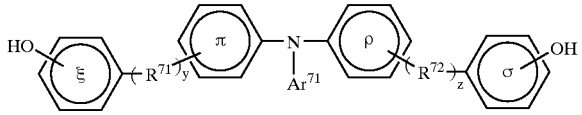

wherein $R^{71}$ and $R^{72}$ each independently represent a divalent hydrocarbon group having 1 to 8 carbon atoms and which may be branched; $Ar^{71}$ represents a substituted or unsubstituted alkyl group, a substituted or unsubstituted aralkyl group, a substituted or unsubstituted aromatic hydrocarbon ring group or a substituted or unsubstituted aromatic heterocyclic group; letter symbols y and z each independently represent 0 or 1; and the benzene ring ξ, π, ρ and σ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; or the benzene rings ξ and π and the benzene rings ρ and σ may each in dependently combine via a substituent to form a ring.

20. The electrophotographic photosensitive member according to claim 1, which is an electrophotographic photosensitive member used for an electrophotographic apparatus comprising an electrophotographic photosensitive member, a charging means, an exposure means, a developing means and a transfer means;

said charging means being a contact charging means having a charging member provided in contact with said electrophotographic photosensitive member;

said charging member being a contact charging member to which only a direct-current voltage is applied to charge said electrophotographic photosensitive member electrostatically.

21. The electrophotographic photosensitive member according to claim 20, which is used for an electrophotographic apparatus and wherein;

said contact charging member is a member comprising i) charging particles for coming into contact with said electrophotographic photosensitive member and ii) a charging-particle-holding member having a surface which has conductivity and elasticity for holding thereon said charging particles; said charging particles having a particle diameter of from 10 nm to 10 μm; and said contact charging means is an injection charging means in which electric charges are directly injected to said electrophotographic photosensitive member surface by means of said charging particles to charge said electrophotographic photosensitive member electrostatically.

22. A process cartridge comprising an electrophotographic photosensitive member and a means selected from the group consisting of a charging means, a developing means, a transfer means and a cleaning means which are integrally supported, and being detachably mountable to the main body of an electrophotographic apparatus, wherein;

said electrophotographic photosensitive member comprises a cylindrical conductive support, and provided thereon a photosensitive layer and a protective layer in this order, which cylindrical conductive support has an outer diameter of less than 30 mm, wherein;

the difference between a coefficient of thermal expansion $\alpha_1$ measured from the top of the protective layer and a coefficient of thermal expansion $\alpha_2$ measured after the protective layer has been removed, $|\alpha_1-\alpha_2|$, is more than $5.0\times10^{-7\circ}$ C.$^{-1}$ to less than $1.0\times10^{-4\circ}$ C.$^{-1}$; and the modulus of elastic deformation We % measured from the top of the protective layer is more than 30% to less than 60%.

23. The process cartridge according to claim 22, wherein said electrophotographic photosensitive member and said charging means at least are integrally supported, and said charging means is a contact charging means having a charging member provided in contact with said electrophotographic photosensitive member;

said charging member being a contact charging member to which only a direct-current voltage is applied to charge said electrophotographic photosensitive member electrostatically.

24. The process cartridge according to claim 2, wherein;

said contact charging member is a member comprising i) charging particles for coming into contact with said electrophotographic photosensitive member and ii) a charging-particle-holding member having a surface which has conductivity and elasticity for holding thereon said charging particles; said charging particles having a particle diameter of from 10 nm to 10 $\mu$m; and said contact charging means is an injection charging means in which electric charges are directly injected to the electrophotographic photosensitive member surface by means of said charging particles to charge said electrophotographic photosensitive member electrostatically.

25. An electrophotographic apparatus comprising an electrophotographic photosensitive member, a charging means, an exposure means, a developing means and a transfer means, wherein;

said electrophotographic photosensitive member comprises a cylindrical conductive support, and provided thereon a photosensitive layer and a protective layer in this order, which cylindrical conductive support has an outer diameter of less than 30 mm, wherein;

the difference between a coefficient of thermal expansion $\alpha_1$ measured from the top of the protective layer and a coefficient of thermal expansion $\alpha_2$ measured after the protective layer has been removed, $|\alpha_1-\alpha_2|$, is more than $5.0\times10^{-7\circ}$ C.$^{-1}$ to less than $1.0\times10^{4\circ}$ C.$^{-1}$; and the modulus of elastic deformation We % measured from the top of the protective layer is more than 30% to less than 60%.

26. The electrophotographic apparatus according to claim 25, wherein said charging means is a contact charging means having a charging member provided in contact with said electrophotographic photosensitive member;

said charging member being a contact charging member to which only a direct-current voltage is applied to charge said electrophotographic photosensitive member electrostatically.

27. The electrophotographic apparatus according to claim 25, wherein;

said contact charging member is a member comprising i) charging particles for coming into contact with said electrophotographic photosensitive member and ii) a charging-particle-holding member having a surface which has conductivity and elasticity for holding thereon said charging particles; said charging particles having a particle diameter of from 10 nm to 10 $\mu$m; and said contact charging means is an injection charging means in which electric charges are directly injected to the electrophotographic photosensitive member surface by means of said charging particles to charge said electrophotographic photosensitive member electrostatically.

* * * * *

UNITED STATES PATENT AND TRADEMARK OFFICE

CERTIFICATE OF CORRECTION

PATENT NO. : 6,806,009 B2
DATED : October 19, 2004
INVENTOR(S) : Daisuke Tanaka et al.

It is certified that error appears in the above-identified patent and that said Letters Patent is hereby corrected as shown below:

Title page,
Item [56], References Cited, FOREIGN PATENT DOCUMENTS,
"57030846" shoould read -- 57-30846 --.

| | |
|---|---|
| 62295066 | 62-295066 |
| 1306857 | 1-306857 |
| 2050167 | 2-50167 |
| 5181299 | 5-181299 |
| 6082223 | 6-82223 |
| 10228126 | 10-228126 |
| 10228127 | 10-228127 |

Column 35,
Line 53, "(35)1," should read -- (35), --.

Column 40,
Line 58, "roller 32a" should read -- roller 32 a --.

Column 50,
Line 16, "$|\alpha_1-\alpha_2$," should read -- $|\alpha_1-\alpha_2|$, --.

Column 53,
Line 22, "RH)" should read -- RH). --

Column 55,
Line 7, "$\alpha_1-\alpha_2$," should read -- $|\alpha_1-\alpha_2|$ --.

Column 56,
Line 39, "of alkali" should read -- of an alkali --.

Column 58,
Line 53, "R43" should read -- $R^{43}$ --.

UNITED STATES PATENT AND TRADEMARK OFFICE

CERTIFICATE OF CORRECTION

PATENT NO. : 6,806,009 B2
DATED : October 19, 2004
INVENTOR(S) : Daisuke Tanaka et al.

It is certified that error appears in the above-identified patent and that said Letters Patent is hereby corrected as shown below:

Column 60,
Line 22, "in depen-" should read -- indepen- --.

Signed and Sealed this

Twenty-ninth Day of March, 2005

JON W. DUDAS
*Director of the United States Patent and Trademark Office*